US009003955B1

(12) United States Patent
Stang et al.

(10) Patent No.: US 9,003,955 B1
(45) Date of Patent: Apr. 14, 2015

(54) PUMP SYSTEMS AND ASSOCIATED METHODS FOR USE WITH WATERJET SYSTEMS AND OTHER HIGH PRESSURE FLUID SYSTEMS

(71) Applicant: OMAX Corporation, Kent, WA (US)

(72) Inventors: Darren Stang, Covington, WA (US); Chidambaram Raghavan, Seattle, WA (US); Scott D. Veenhuizen, Covington, WA (US)

(73) Assignee: OMAX Corporation, Kent, WA (US)

( * ) Notice: Subject to any disclaimer, the term of this patent is extended or adjusted under 35 U.S.C. 154(b) by 0 days.

(21) Appl. No.: 14/164,062

(22) Filed: Jan. 24, 2014

(51) Int. Cl.

| | |
|---|---|
| ***F01B 1/02*** | (2006.01) |
| ***F04B 11/00*** | (2006.01) |
| ***F04B 39/12*** | (2006.01) |
| ***F04B 1/14*** | (2006.01) |
| ***B26F 3/00*** | (2006.01) |

(52) U.S. Cl.
CPC ..... *F04B 1/143* (2013.01); *B26F 3/004* (2013.01)

(58) Field of Classification Search
USPC ..... 92/58, 73, 148; 417/539, 569
See application file for complete search history.

(56) References Cited

U.S. PATENT DOCUMENTS

| | | | | |
|---|---|---|---|---|
| 2,340,975 | A | | 2/1944 | Morgan |
| 2,463,552 | A | | 3/1949 | Newhall |
| 2,550,435 | A | | 4/1951 | Willke |
| 2,570,698 | A | | 10/1951 | Manseau |
| 2,819,835 | A | | 1/1958 | Newhall |
| 3,114,326 | A | | 12/1963 | Yaindl |
| 3,373,695 | A | | 3/1968 | Yohpe |
| 3,427,988 | A | | 2/1969 | Redman et al. |
| 3,614,265 | A | | 10/1971 | Ohrberg |
| 3,702,624 | A | | 11/1972 | Fries |
| 3,746,483 | A | | 7/1973 | Hindel et al. |
| 4,029,440 | A | | 6/1977 | Olsen |
| 4,048,841 | A | | 9/1977 | Kent |
| 4,050,862 | A | | 9/1977 | Buse |
| 4,102,611 | A | | 7/1978 | Broker |
| 4,146,355 | A | | 3/1979 | Broker et al. |
| 4,173,435 | A | | 11/1979 | Hammelmann |
| 4,184,817 | A | | 1/1980 | Pareja |
| 4,195,970 | A | | 4/1980 | Zalis |
| 4,428,275 | A | | 1/1984 | Huperz et al. |
| 4,477,237 | A | * | 10/1984 | Grable ..... 92/73 |
| 4,494,415 | A | * | 1/1985 | Elliston ..... 92/73 |
| 4,527,957 | A | | 7/1985 | Dettinger et al. |
| 4,536,135 | A | | 8/1985 | Olsen et al. |
| 4,556,371 | A | * | 12/1985 | Post ..... 417/539 |
| 4,566,370 | A | | 1/1986 | Hanafi |
| 4,616,983 | A | | 10/1986 | Hanafi |

(Continued)

FOREIGN PATENT DOCUMENTS

| | | | |
|---|---|---|---|
| CN | 201650635 | U | 11/2010 |
| CN | 201827039 | U | 5/2011 |
| GB | 1078145 | A | 8/1967 |

*Primary Examiner* — Michael Leslie
(74) *Attorney, Agent, or Firm* — Perkins Coie LLP

(57) ABSTRACT

High pressure pump systems with reduced pressure ripple for use with waterjet systems and other systems are described herein. A pump system configured in accordance with a particular embodiment includes four reciprocating members operably coupled to a crankshaft at 90 degree phase angles. The reciprocating members can include plungers operably disposed in corresponding cylinders and configured to compress fluid (e.g., water) in the cylinders to pressures suitable for waterjet processing, such as pressures exceeding 30,000 psi.

33 Claims, 12 Drawing Sheets

(56) References Cited

U.S. PATENT DOCUMENTS

| | | | | | |
|---|---|---|---|---|---|
| 4,634,353 | A | | 1/1987 | Huperz | |
| 4,687,426 | A | * | 8/1987 | Yoshimura | 417/539 |
| 4,729,720 | A | | 3/1988 | Fujita | |
| 4,762,051 | A | | 8/1988 | Besic et al. | |
| 4,776,769 | A | | 10/1988 | Hilaris | |
| 4,780,064 | A | | 10/1988 | Olsen | |
| 4,790,732 | A | * | 12/1988 | Yamatani | 417/539 |
| 4,878,815 | A | * | 11/1989 | Stachowiak | 417/539 |
| 4,893,753 | A | | 1/1990 | Munoz et al. | |
| 4,960,039 | A | * | 10/1990 | Robertson | 417/569 |
| 5,102,312 | A | | 4/1992 | Harvey | |
| 5,317,873 | A | | 6/1994 | Okuda et al. | |
| 5,337,561 | A | | 8/1994 | Raghavan et al. | |
| 5,411,380 | A | * | 5/1995 | Bristol et al. | 417/539 |
| 5,577,390 | A | | 11/1996 | Kaido et al. | |
| 5,800,134 | A | | 9/1998 | Hasegawa et al. | |
| 5,975,864 | A | | 11/1999 | De Santis et al. | |
| 6,139,288 | A | | 10/2000 | Karasawa | |
| 6,152,014 | A | | 11/2000 | Willimczik | |
| 6,443,705 | B1 | | 9/2002 | Munoz | |
| 6,622,612 | B2 | | 9/2003 | Notzon | |
| 6,913,447 | B2 | | 7/2005 | Fox et al. | |
| 6,960,069 | B2 | | 11/2005 | Maruta et al. | |
| 6,970,793 | B2 | | 11/2005 | Pearson et al. | |
| 6,979,125 | B2 | | 12/2005 | Vicars | |
| 7,121,812 | B2 | | 10/2006 | Forrest | |
| 7,165,396 | B2 | | 1/2007 | Zumbusch | |
| 7,905,711 | B2 | | 3/2011 | Mochizuki et al. | |
| 8,267,672 | B2 | | 9/2012 | Kellar et al. | |
| 8,322,997 | B2 | | 12/2012 | Auer et al. | |
| 2007/0009367 | A1 | | 1/2007 | Tischler et al. | |
| 2008/0000065 | A1 | | 1/2008 | Ganguly et al. | |
| 2010/0310384 | A1 | | 12/2010 | Stephenson et al. | |
| 2012/0186518 | A1 | | 7/2012 | Herre et al. | |
| 2012/0201706 | A1 | | 8/2012 | Liu et al. | |
| 2012/0272764 | A1 | | 11/2012 | Pendleton | |
| 2013/0112074 | A1 | | 5/2013 | Small | |

* cited by examiner

PUMP SYSTEMS AND ASSOCIATED METHODS FOR USE WITH WATERJET SYSTEMS AND OTHER HIGH PRESSURE FLUID SYSTEMS

TECHNICAL FIELD

The present disclosure is directed generally to high and ultrahigh pressure pump systems and associated methods for use with fluid-jet systems and other systems.

BACKGROUND

There are various commercial and industrial uses for high pressure fluid pump systems operating at pressures greater than 20,000 psi. Such pump systems can be used in, for example, fluid-jet cutting systems, fluid-jet cleaning systems, etc. Fluid-jet cutting systems often use reciprocating, positive displacement pumps (e.g., crankshaft-driven plunger pumps). Crankshaft-driven plunger pumps, such as triplex plunger pumps (i.e., pumps having three cylinders and associated plungers) operating at outlet pressures of 20,000 psi or more produce pressure pulsations caused by the cyclic output from the pump cylinders. These pressure pulsations can produce undesirably high levels of pressure ripple downstream from the pump. The pressure ripple can be partially mitigated by use of a pump output manifold that contains a volume of the high pressure fluid before it flows to downstream applications.

Conventional low pressure crankshaft-driven, reciprocating positive displacement pumps operating at outlet pressures of 7,500 psi or less typically use pistons instead of plungers. One reason for this is that piston pumps generally have much higher volumetric efficiencies that plunger pumps. Piston pumps, however, can also create significant pressure pulsation during operation. As a result, such pumps are typically used with pulsation dampeners to reduce pressure ripple downstream of the pump. Pulsation dampeners typically include a vessel having a resilient diaphragm with a gas (such as nitrogen) on one side of the diaphragm and the media being pumped (e.g., water) on the opposite side of the diaphragm. In operation, water discharged from the pump flows into the dampener vessel, with the diaphragm alternatingly expanding and compressing the gas as the water pressure increases, and then contracting and letting the gas expand against the water as the water flows out of the vessel and the pressure decreases. Pulsation dampeners are usually attached directly to the output manifold of the pump. In this way, dampeners can reduce pressure pulsations in the water downstream from the pump.

Gas filled pulsation dampeners tend to lose effectiveness as output pressures increase and the gas begins to go through a phase change to a liquid or supercritical fluid. As noted above, high pressure pumps typically rely primarily on the volume of fluid in the output manifold to reduce pressure ripple. Pressure attenuators can also be used to mitigate pump pressure ripple. Pressure attenuators are essentially pressure vessels that accumulate the high pressure water from the pump cylinders to dampen pressure fluctuations in the water as it is provided to, for example, a fluid-jet cutting head or other downstream application. Pressure attenuators are generally placed as close to the pump as possible, but even with relatively large attenuators, these systems can still experience relatively large pressure fluctuations during pump operation that results in downstream pressure ripple.

Fluid-jet systems (e.g., waterjet or abrasive-jet systems) are one of the areas of technology that utilize ultrahigh pressure pumps. Fluid-jet systems can be used in precision cutting, shaping, carving, reaming, and other material-processing applications. The liquid most frequently used to form the jet is water, and the high-velocity jet may be referred to as a "water jet" or "waterjet." In operation, waterjet systems typically direct a high-velocity jet of water toward a workpiece to rapidly erode portions of the workpiece. Abrasive material can be added to the fluid to increase the rate of erosion. When compared to other shape-cutting systems (e.g., electric discharge machining (EDM), laser cutting, plasma cutting, etc.), waterjet systems can have significant advantages. For example, waterjet systems often produce relatively fine and clean cuts, typically without heat-affected zones around the cuts. Waterjet systems also tend to be highly versatile with respect to the material type of the workpiece. The range of materials that can be processed using waterjet systems includes very soft materials (e.g., rubber, foam, leather, and paper) as well as very hard materials (e.g., stone, ceramic, and hardened metal). Furthermore, in many cases, waterjet systems are capable of executing demanding material-processing operations while generating little or no dust, smoke, and/or other potentially toxic byproducts.

In a typical waterjet system, a pump pressurizes water to a high pressure (e.g., up to 60,000 psi or more), and the water is routed from the pump to a cutting head that includes an orifice. Passing the water through the orifice converts the static pressure of the water into kinetic energy, which causes the water to exit the cutting head as a jet at high velocity (e.g., up to 2,500 feet per second or more) and impact a workpiece. In many cases, a jig supports the workpiece. The jig, the cutting head, or both can be movable under computer and/or robotic control such that complex processing instructions can be executed automatically.

The pressure ripple produced by conventional crankshaft-driven plunger pumps used in waterjet systems have a number of disadvantages. For example, the pulsations can cause vibration and fatigue in the fluid conduits and other components that make up the high pressure fluid circuit between the pump and the cutting head. Additionally, the pressure pulses can cause vibration of the cutting head, which adversely affects the waterjet cutting quality. As discussed above, methods for mitigating pressure ripple typically include increasing the volume of the pump manifold or adding a pressure attenuator to the system. Although somewhat effective, neither approach is an ideal solution. Pressure manifolds typically have cross-bores that receive the output flow from each pump cylinder. The cross-bores within the manifold can create areas of high stress concentrations that limit component life due to eventual fatigue failure. In addition, pressure manifolds can be relatively expensive to manufacture, and the cost generally increases as the size of the manifold increases. As noted, some pumps are fitted with pressure attenuators to reduce pressure ripple and mitigate the disadvantages discussed above. As with pressure manifolds, however, large pressure attenuators can also be costly to manufacture due to component size. Although attenuators do not have cross-bores, they are also subject to fatigue failure. In addition, increasing the volume of pressurized water stored in a pressure manifold or attenuator has the downside of increasing stored energy within the pump system. Moreover, neither output manifolds nor pressure attenuators provide the full extent of pulse attenuation desired. Accordingly, it would be desirable to have waterjet pump systems that produce less pressure ripple than conventional pump systems to reduce fatigue failures and enhance cutting quality.

BRIEF DESCRIPTION OF THE DRAWINGS

Many aspects of the present disclosure can be better understood with reference to the following drawings. The components in the drawings are not necessarily to scale. Instead, emphasis is placed on clearly illustrating the principles of the present technology. For ease of reference, throughout this disclosure identical reference numbers may be used to identify identical or at least generally similar or analogous components or features.

DETAILED DESCRIPTION

Figure 1:
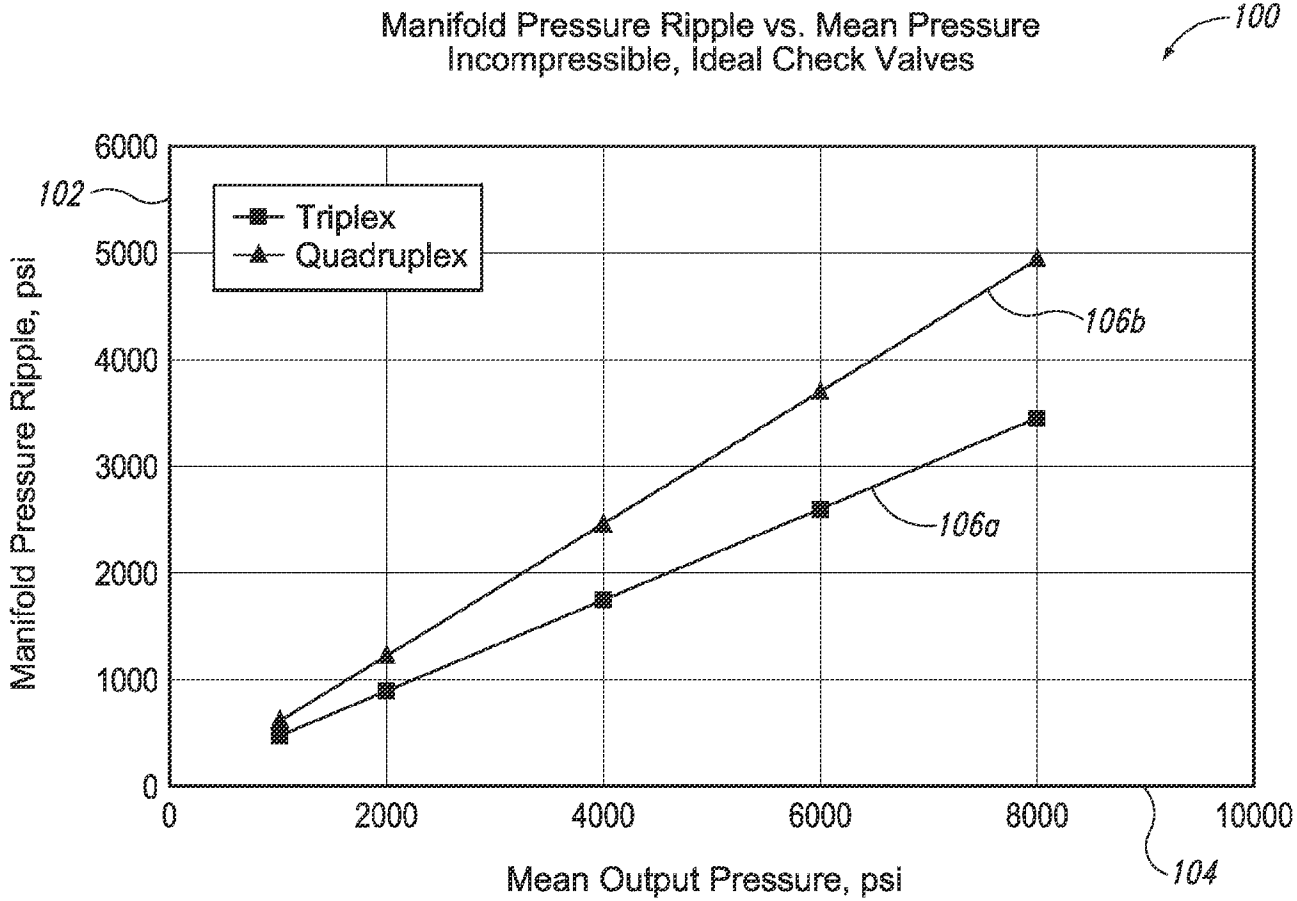
FIG. 1 is a graph illustrating pump manifold pressure ripple versus mean output pressure for triplex and quadruplex crankshaft-driven pump configurations, assuming water incompressibility and ideal check valves.

The following disclosure describes various embodiments of pump systems for use with, e.g., water, aqueous solutions, etc., that can provide high and ultrahigh pressure fluid with lower magnitude pressure pulses or ripples than conventional pump systems. As described in greater detail below, in the process of developing the present technology, the inventors unexpectedly found that increasing the number of cylinders in a positive displacement reciprocating plunger pump from three to four actually reduced the magnitude of pressure ripples at pressures greater than about 7,500 psi, even though increasing the number of cylinders from three to four in lower pressure applications (e.g., about 4,000 psi) produced the opposite result of increasing the magnitude of pressure ripples. Moreover, the relative improvement in ripple reduction of the quadruplex pump (i.e., four cylinder pump) over the triplex pump increases dramatically at increased outlet pressures. This discovery was made after constructing and successfully predicting the outlet manifold pressure ripple for a sextuplex (i.e., six cylinder) crankshaft-driven plunger pump intended to operate at pressures up to 60,000 psi, and applying the technology to a similarly-configured quadruplex plunger pump.

In some embodiments of the present technology, the pump systems described herein include four reciprocating members, such as plungers, operably disposed in corresponding cylinders mounted to a crankcase. Each cylinder can include an inlet check valve and an outlet check valve. The plungers can be operably coupled to a crankshaft rotatably disposed in the crankcase via corresponding connecting rods. Each of the connecting rods can be operably coupled to the crankshaft via a corresponding connecting rod journal. Each of the rod journals can be evenly spaced apart from the others by a crankshaft angle of 90 degrees. In operation, a motor (e.g., an electric motor, diesel motor, etc.) drives the crankshaft at a selected RPM, and the plungers reciprocate in cycles that are 90 degrees out of phase from each other. As the plungers reciprocate, they draw low pressure water into the cylinders via the inlet check valves and drive high pressure water (e.g., water at a pressure greater than 20,000 psi) out of the cylinders and into, e.g., an outlet manifold via the outlet check valves. Prior to the conception of the present invention, the inventors were unaware of any such prior art quadruplex plunger pump suitable for providing fluid at pressures suitable for waterjet processing (e.g., pressures greater than 30,000 psi).

The different pump systems and associated methods described herein can be used in a wide variety of commercial, industrial, and/or home applications including, for example, fluid-jet cutting systems (e.g., waterjet or abrasive-jet systems), fluid-jet cleaning systems, etc. Although the embodiments are disclosed herein primarily or entirely with respect to waterjet applications, other applications in addition to those disclosed herein are within the scope of the present technology. For example, pump systems and related methods configured in accordance with at least some embodiments of the present technology can be useful in various other high-pressure fluid-conveyance systems. Furthermore, waterjet systems configured in accordance with embodiments of the present technology can be used with virtually any liquid media pressurized to 20,000 psi or more, such as water, aqueous solutions, hydrocarbons, glycol, and liquid nitrogen, among others. As such, although the term "waterjet" is used herein for ease of reference, unless the context clearly indicates otherwise, the term refers to a jet formed by any suitable fluid and is not limited exclusively to water or aqueous solutions.

Certain details are set forth in the following description and in FIGS. 1-12 to provide a thorough understanding of various systems and methods embodying this fluid pressurizing innovation. Other details describing well-known aspects of pressurizing devices and systems (e.g., crankshaft-driven positive displacement plunger pump systems, etc.) and waterjet systems are not set forth in the following disclosure, however, to avoid unnecessarily obscuring the description of the various embodiments. Many of the details, dimensions, angles, and other features shown in the Figures are merely illustrative of particular embodiments. Accordingly, other embodiments can have other details, dimensions, angles, and features without departing from the spirit or scope of the present technology. In addition, further embodiments can be practiced without several of the details described below. To facilitate the discussion of any particular element, the most significant digit or digits of any reference number generally refers to the Figure in which that element is first introduced. For example, element 100 is first introduced and discussed with reference to FIG. 1.

FIG. 1 presents a graph 100 that contains plots 106*a* and 106*b* illustrating predicted output manifold pressure ripple versus mean output pressure for triplex and quadruplex crankshaft-driven positive displacement pumps, respectively. The data presented in FIG. 1 assumes that the process fluid (e.g., water) is incompressible water and that the inlet and outlet check valves associated with each pump cylinder are ideal (e.g., disregarding volumetric efficiency). In the illustrated embodiment, the triplex and quadruplex pumps can be either crankshaft-driven plunger pumps or crankshaft-driven piston pumps, and except for the number of cylinders, the internal components associated with the two plunger pumps are assumed to be identical in all pertinent respects, as are the internal components associated with the two piston pumps. In the graph 100, manifold pressure ripple in psi is measured on a vertical axis 102, and mean output pressure in psi is measured along a horizontal axis 104. The first plot 106*a* illustrates pressure ripple for a triplex pump having three plungers (or pistons) and three corresponding cylinders, and the second plot 106*b* illustrates pressure ripple for a quadruplex pump having four plungers (or pistons) and four corresponding cylinders. As used herein, the term "manifold pressure ripple" refers to the difference between the maximum discharge or outlet manifold pressure and the minimum outlet manifold pressure from each cylinder during a complete operating cycle of the pump (e.g., during 360 degrees of crankshaft rotation). This assumes that the high pressure water from each pump cylinder flows into a common outlet manifold at which the manifold pressure is measured. The plots 106*a* and 106*b* are based on the pumps having evenly spaced apart plunger/piston cycles during operation. For example, the triplex pump has three plunger/piston cycles that occur every full crankshaft rotation, and the cycles are separated by equal phase angles (crankshaft angles) of 120 degrees. Similarly, the quadruplex pump has four plunger/piston cycles that occur every full crankshaft rotation, and the cycles are separated by equal phase angles of 90 degrees.

As a comparison of the first plot 106*a* to the second plot 106*b* illustrates, when water is assumed to be incompressible, a triplex pump produces lower pressure ripple than a corresponding quadruplex pump, and the difference in pressure ripple increases as the output pressure increases. Accordingly, based on the data shown in FIG. 1, one would not be motivated to increase the number of pump cylinders from three to four because doing so would not only increase the cost and complexity of the pump, but it would also increase the magnitude of pressure pulsations in the output flow, which would be detrimental to use of the pump with, for example, a waterjet system for the reasons discussed above. In practice, pumps having greater numbers of cylinders have greater complexity and higher production and maintenance costs than pumps having fewer cylinders, particularly for pumps configured for use at ultrahigh pressures. As used herein, the term "ultrahigh pressure" can refer to pressures of 30,000 psi and higher. In view of the greater complexity and costs, and the relationships shown in FIG. 1, triplex pumps have become standard in many applications, including waterjet applications.

Figure 2A:
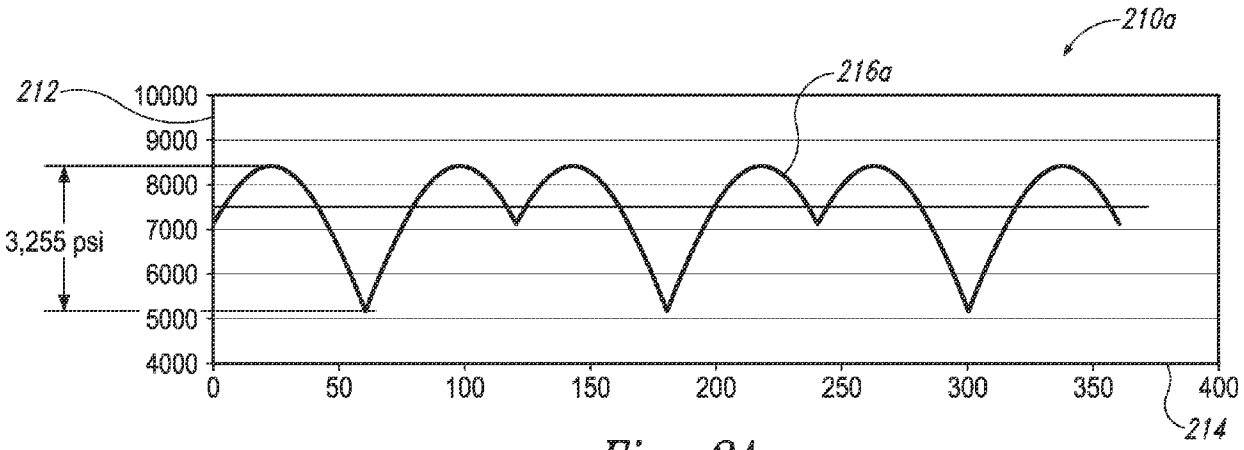
FIGS. 2A and 2B are graphs illustrating pump manifold pressure versus crankshaft angle for the triplex and quadruplex pump configurations of FIG. 1, respectively, operating at a mean output pressure of 7,500 psi and assuming water incompressibility and ideal check valves.
Figure 2B:
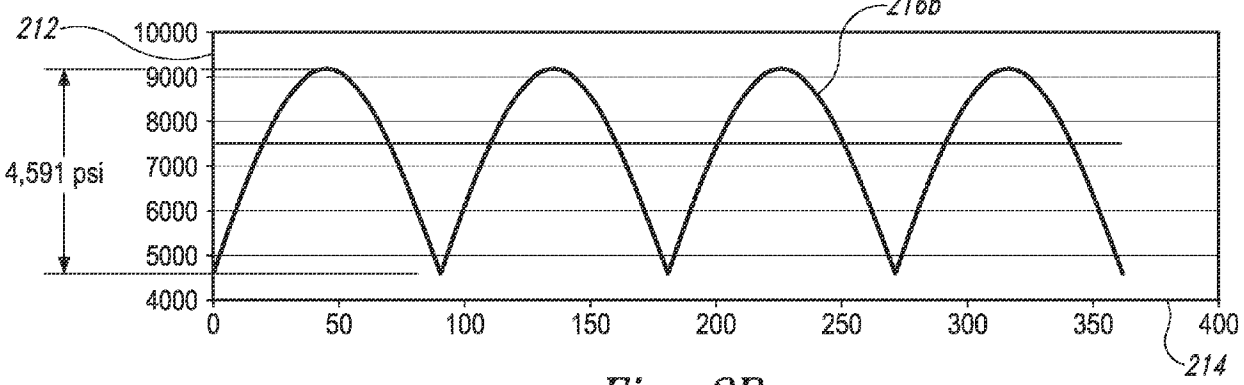

FIGS. 2A and 2B present graphs 210*a* and 210*b* containing plots 216*a* and 216*b*, respectively, illustrating predicted pump outlet manifold pressure as a function of crankshaft angle of rotation for the triplex and quadruplex pump configurations of FIG. 1, respectively. As in FIG. 1, water is assumed to be incompressible and the pump cylinders are assumed to have ideal inlet and outlet check valves. In each of the graphs 210, manifold pressure (in psi) is measured along a vertical axis 212, crankshaft angle of rotation (in degrees) is measured along a horizontal axis 214, and both of the pumps are operating at a mean output pressure of 7,500 psi. The shapes of the plots 216*a* and 216*b* represent the shapes and relative magnitudes of the pressure ripple produced by the particular pump configurations.

As stated above with reference to FIG. 1, when water is assumed to be incompressible, the graph 100 illustrates that a three cylinder pump produces less pressure ripple than a four cylinder pump in all pressure regimes. This result is further illustrated by the graphs 210*a* and 210*b*. For example, as shown by the first plot 216*a* in FIG. 2A, the triplex pump produces a pressure ripple of about 3,260 psi when operating at a mean output pressure of 7,500 psi. By comparison, the second plot 216*b* in FIG. 2B shows that the quadruplex pump produces a much larger pressure ripple of about 4,600 psi at the same mean output pressure. This increase in pressure ripple and the additional cost and complexity associated with adding a cylinder explains why it would not have been obvious to increase the number of pump cylinders from three to four. For this reason, conventional systems utilizing high pressure water (e.g., water at 20,000 psi or above), such as waterjet systems, typically use triplex pumps and attempt to mitigate the adverse effects of pressure pulsations with manifolds or attenuators.

Figure 3:
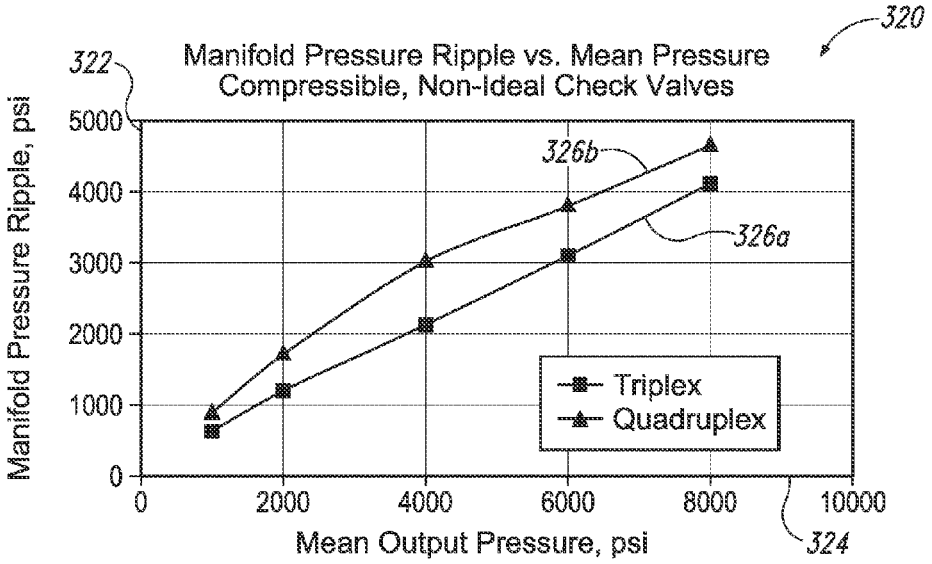
FIG. 3 is a graph illustrating pump manifold pressure ripple versus mean output pressure for triplex and quadruplex crankshaft-driven, reciprocating piston pump configurations, assuming water compressibility and non-ideal check valves.

FIG. 3 presents a graph 320 containing plots 326*a* and 326*b* that illustrate predicted pump manifold pressure ripple with no dampening versus mean output pressure for triplex and quadruplex crankshaft-driven piston pump configurations, respectively, up to a mean output pressure of 8,000 psi. Except for the number of cylinders, the two piston pumps are assumed to be the same in all pertinent respects. Manifold pressure ripple in psi is measured along a vertical axis 322, and mean output pressure in psi is measured along a horizontal axis 324. In contrast to FIG. 1, the data presented in the graph 320 assumes that water is compressible and that the pump cylinders have non-ideal check valves. As a comparison of the first plot 326*a* to the second plot 326*b* illustrates, however, even when water is assumed to be compressible, quadruplex piston pumps still produce greater pressure ripple than comparable triplex piston pumps in the pressure regimes in which piston pumps are most practical. As a result, increasing the number of pump cylinders from three to four in such piston pumps not only has the disadvantage of increasing the cost and complexity of the pump, but also the disadvantage of increasing the magnitude of the pressure pulsations in the output flow.

Figure 4A:
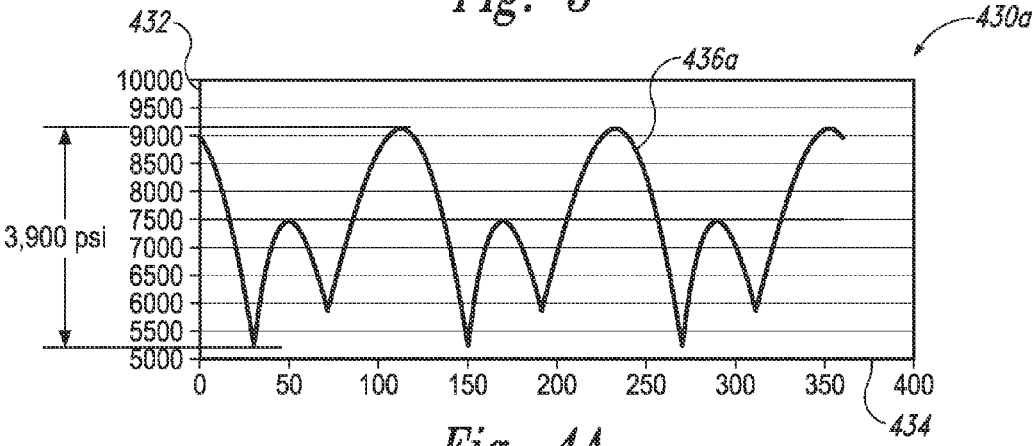
FIGS. 4A and 4B are graphs illustrating pump manifold pressure versus crankshaft angle for the triplex and quadruplex piston pump configurations of FIG. 3, respectively, operating at a mean output pressure of 7,500 psi and assuming water compressibility and non-ideal check valves.
Figure 4B:
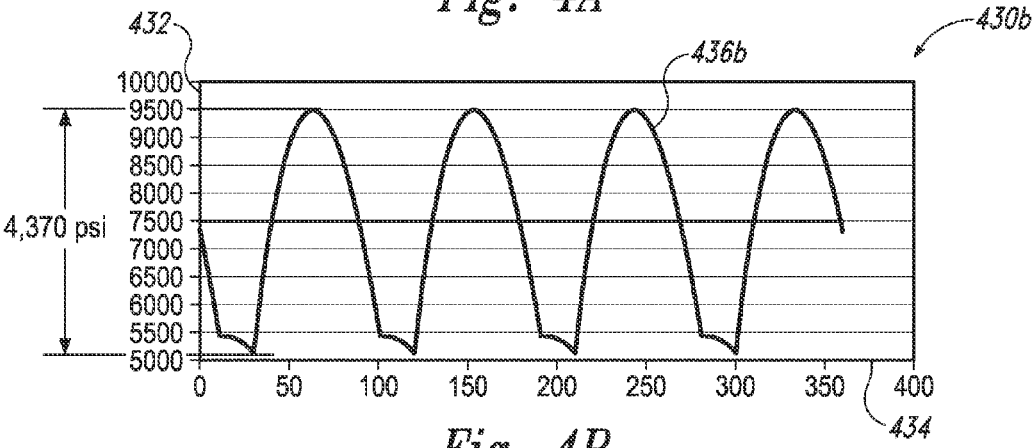

FIGS. 4A and 4B present graphs 430*a* and 430*b* containing plots 436*a* and 436*b*, respectively, illustrating predicted pump outlet manifold pressure with no dampening as a function of crankshaft angle for the triplex and quadruplex piston pump configurations of FIG. 3, respectively, operating at a mean output pressure of 7,500 psi. As in FIG. 3, water is assumed to be compressible and the pump cylinders are assumed to have non-ideal inlet and outlet check valves. In each of the graphs 430, manifold pressure (in psi) is measured along a vertical axis 432, and crankshaft angle (in degrees) is measured along a horizontal axis 434. As noted above with reference to FIG. 3, quadruplex piston pumps produce pressure ripples of greater magnitude than comparable triplex piston pumps in the pressure regimes in which piston pumps are most practical (e.g., pressures below about 15,000 psi). This conclusion is further illustrated by comparing the first plot 436*a* in FIG. 4A to the second plot 436*b* in FIG. 4B. As these plots illustrate, the triplex piston pump (plot 436*a*) produces a pressure ripple of about 3,900 psi when operating at a mean output pressure of 7,500 psi, while the quadruplex piston pump produces a greater pressure ripple of about 4,370 psi at the same mean output pressure.

Figure 5:
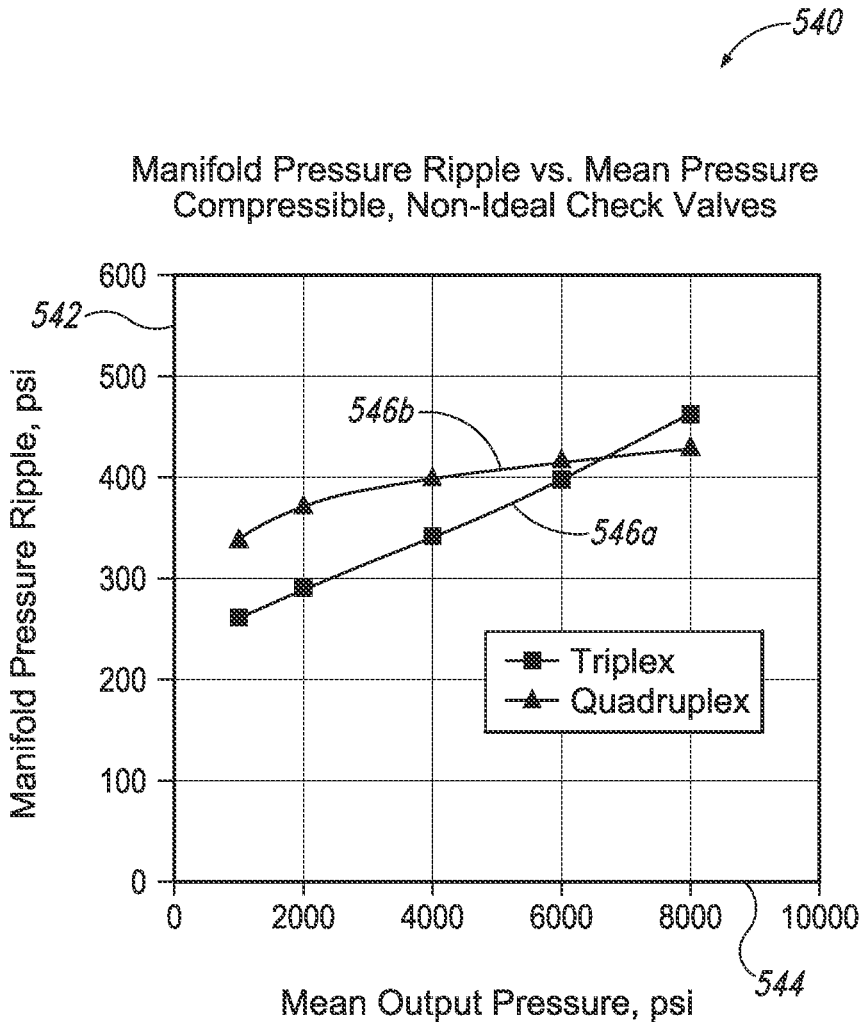
FIG. 5 is a graph illustrating pump manifold pressure ripple versus mean output pressure for triplex and quadruplex crankshaft-driven, reciprocating plunger pump configurations, operating in a pressure regime from 1,000 psi to 8,000 psi, and assuming water compressibility and non-ideal check valves.

FIG. 5 presents a graph 540 containing plots 546*a* and 546*b* illustrating predicted pump manifold pressure ripple versus mean output pressure for triplex and quadruplex crankshaft-driven, reciprocating plunger pump configurations, respectively, assuming water compressibility and non-ideal check valves. Except for the number of cylinders, the two plunger pumps are assumed to be identical in all pertinent respects and have proportionally sized outlet manifolds. In FIG. 5, manifold pressure ripple in psi is measured along a vertical axis 542, and mean output pressure in psi is measured along a horizontal axis 544. As with the graph 100 of FIG. 1, the graph 540 presents ripple data in the pressure regime from 1,000 psi up to 8,000 psi. Most plunger pumps rated to operate at pressures up to about 8,000 psi typically operate at much lower pressures in use, such as pressures below about 7,000 psi. As the graph 540 illustrates, quadruplex plunger pumps operating in this pressure regime produce higher pressure ripple than comparable triplex pumps, even when water compressibility and non-ideal check valves are taken into account. The higher pressure ripple associated with quadruplex plunger pumps operating in this pressure regime, coupled with the added cost and complexity of a quadruplex pump as compared to a triplex pump, explain why conventional systems utilizing water at pressures below about 8,000 psi typically use triplex pumps.

Figure 6A:
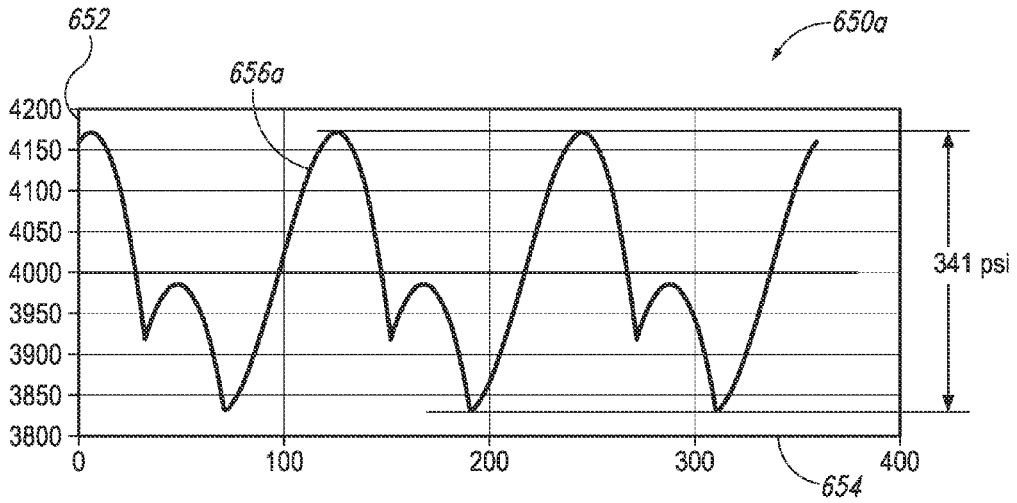
FIGS. 6A and 6B are graphs illustrating pump manifold pressure versus crankshaft angle for the triplex and quadruplex pump configurations of FIG. 5, respectively, operating at a mean output pressure of 4,000 psi, and assuming water compressibility and non-ideal check valves.
Figure 6B:
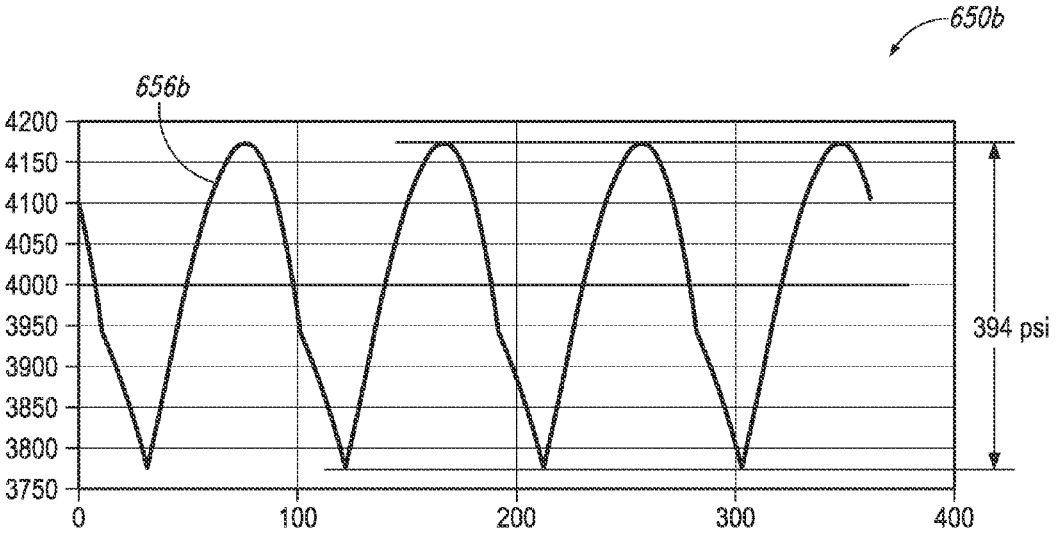

FIGS. 6A and 6B present graphs 650*a* and 650*b* containing plots 656*a* and 656*b*, respectively, illustrating predicted pump manifold pressure versus crankshaft angle for the triplex and quadruplex plunger pump configurations of FIG. 5, respectively. As with FIG. 5, the process fluid (e.g., water) is assumed to be compressible and the cylinder inlet and outlet check valves are assumed to be non-ideal. In each of the graphs 650, manifold pressure (in psi) is measured along a vertical axis 652, crankshaft angle (in degrees) is measured along a horizontal axis 654, and both of the pumps are operating at a mean output pressure of 4,000 psi. As stated above with reference to FIG. 5, at most pressures below about 8,000 psi, quadruplex plunger pumps produce greater pressure ripple than comparable triplex plunger pumps, regardless of whether water is assumed to be compressible or incompressible. This is further illustrated by comparison of the first plot 656*a* to the second plot 656*b*, which shows that the triplex plunger pump (plot 656*a*) produces a pressure ripple of about 341 psi when operating at a mean output pressure of 4,000 psi, while the quadruplex plunger pump (plot 656*b*) produces a larger pressure ripple of about 394 psi at the same mean output pressure. This detrimental increase in pressure ripple and the additional cost and complexity associated with adding a pump cylinder further explain why conventional systems utilizing high pressure water (e.g., water at pressures of 20,000 psi or more), such as waterjet systems, typically use triplex pumps and attempt to mitigate the adverse effects of pressure pulsations with manifolds or attenuators.

Liquid water is assumed to be incompressible in most engineering calculations at low pressure. This assumption is reasonable, because water is relatively incompressible in most applications. This assumption is also expedient, since accurately accounting for the compressibility of water in engineering calculations is not trivial. The compression behavior of water is not well documented for many applications and, accordingly, analytical tools (e.g., models) that account for the compressive behavior of water often must be developed from scratch. Given these considerations, it is not surprising that, to the inventors' knowledge, ultrahigh pressure quadruplex pumps configured in accordance with the technology described herein do not exist. As discussed above, based on the relationships shown in FIGS. 1-6B, it would be irrational to build a quadruplex pump instead of a triplex pump when reducing the magnitude of pressure ripples, reducing complexity, and reducing costs are desirable, as is virtually always the case. The inventors have discovered, however, that this conventional wisdom does not hold true at ultrahigh pressures. Contrary to expectation, in developing the present technology the inventors determined that a quadruplex pump actually produces significantly less manifold pressure ripple than a comparable triplex pump at higher pressures (e.g., 20,000 psi or more), with the cross-over in performance occurring at about 7,000 psi. The inventors have accurately modeled the magnitude of output pressure ripples relative to the number of pump cylinders in a way that fully accounts for the compressibility of water. The results of this effort are discussed in greater detail below.

Figure 7:
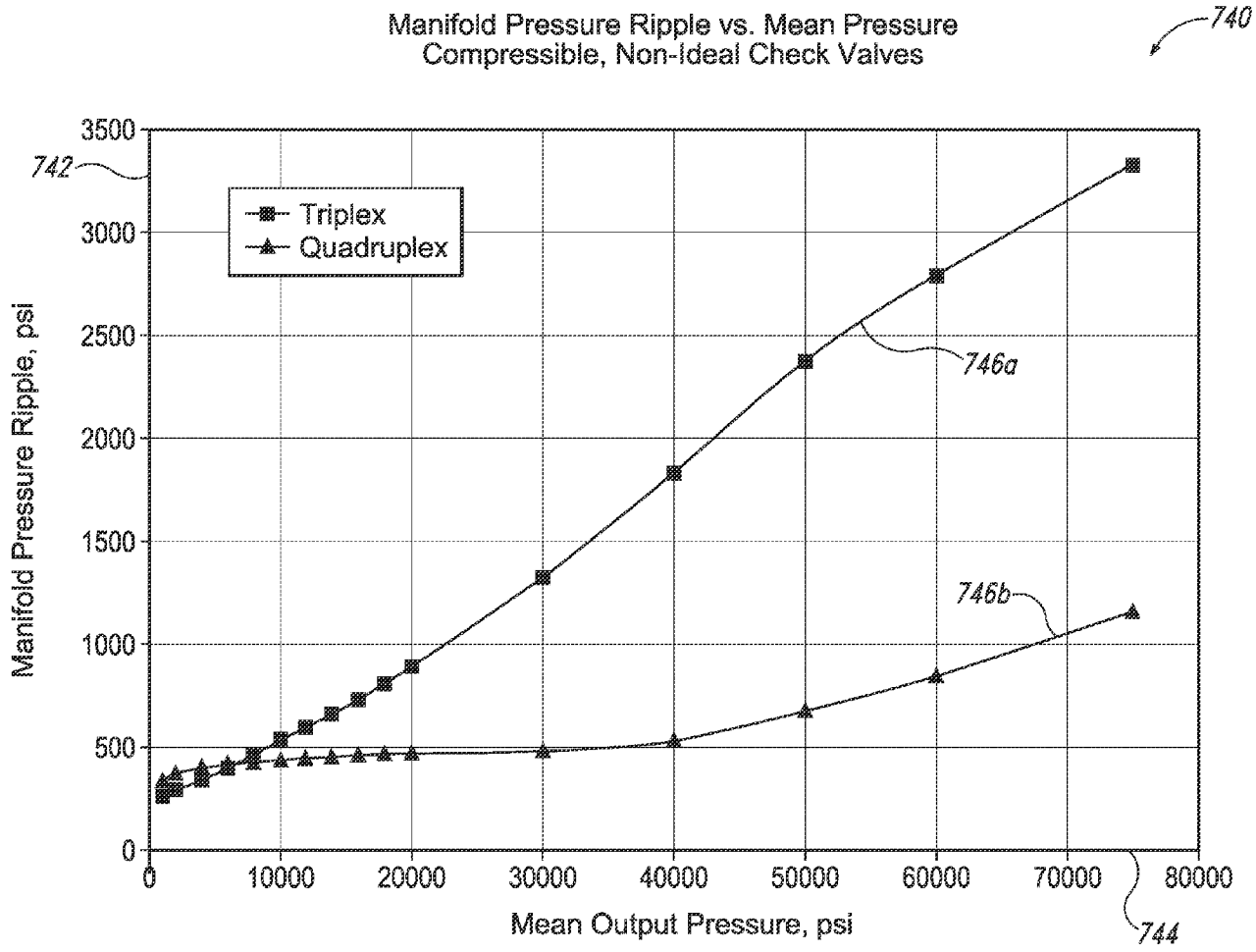
FIG. 7 is a graph illustrating pump manifold pressure ripple versus mean output pressure for the pump configurations of FIG. 5, operating in a pressure regime from 1,000 psi to 75,000 psi, and assuming water compressibility and non-ideal check valves.

FIG. 7 presents a graph 740 containing plots 746*a* and 746*b* illustrating predicted pump manifold pressure ripple versus mean output pressure for the triplex and quadruplex plunger pump configurations of FIG. 5, respectively. Manifold pressure ripple in psi is measured along a vertical axis 742, and mean output pressure in psi is measured along a horizontal axis 744. As with the graph 540 of FIG. 5, the data presented in the graph 740 accounts for water compressibility and non-ideal check valves. Unlike the graph 540, however, the graph 740 presents ripple data in the pressure regime from 1,000 psi up to 75,000 psi. As the graph 740 dramatically illustrates, triplex plunger pumps (as shown by the plot 746*a*) produce increasingly greater pressure ripple than comparable quadruplex pumps (plot 746*b*) as the pump output pressure increases above about 7,500 psi.

Figure 8A:
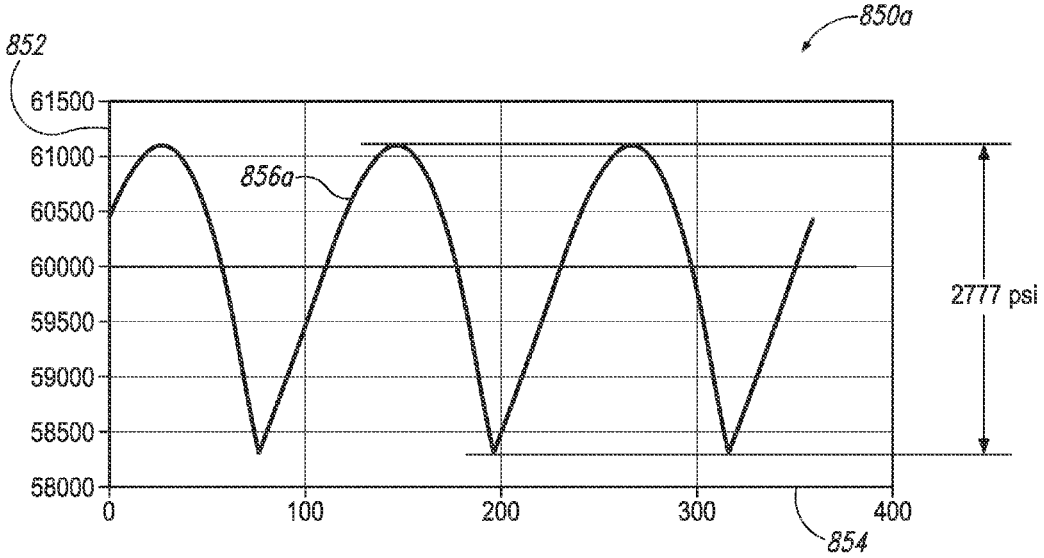
FIGS. 8A and 8B are graphs illustrating pump manifold pressure versus crankshaft angle for the triplex and quadruplex pump configurations of FIG. 5, respectively, operating at a mean output pressure of 60,000 psi, and assuming water compressibility and non-ideal check valves.
Figure 8B:
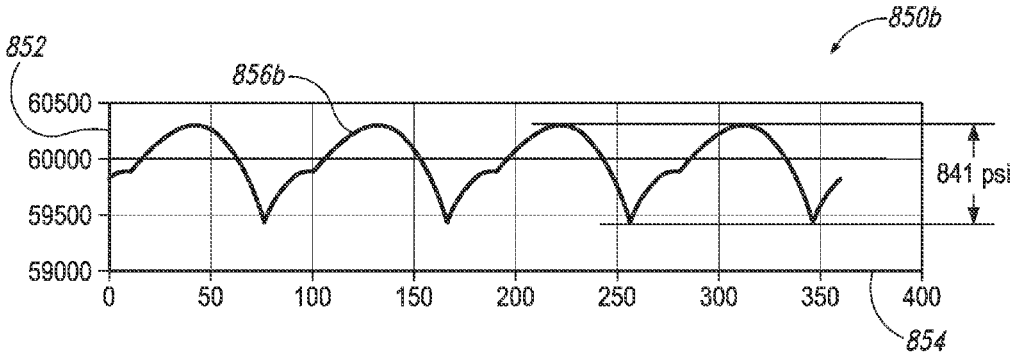

FIGS. 8A and 8B present graphs 850*a* and 850*b*, respectively, which further illustrate the dramatic reduction in pressure ripple provided by quadruplex plunger pumps as compared to triplex plunger pumps at pressures greater than, for example, 20,000 psi. In the graphs 850, manifold outlet pressure in psi is measured along a vertical axis 852, and crankshaft angle in degrees is measured along a horizontal axis 854. The first graph 850*a* includes a plot 856*a* of predicted manifold output pressure as a function of crankshaft angle for the triplex plunger pump configuration of FIG. 7, operating at a mean output pressure of 60,000 psi. The second graph 850*b* includes a similar plot 856*b* for the quadruplex plunger pump configuration of FIG. 7, also operating at a mean output pressure of 60,000 psi. As with FIG. 7, the process fluid (e.g., water) is assumed to be compressible, and the cylinder inlet and outlet check valves are assumed to be non-ideal. The first plot 856*a* in FIG. 8A illustrates that the triplex plunger pump produces a pressure ripple of approximately 2,777 psi when operating at a mean output pressure of 60,000 psi. In contrast, the second plot 856*b* in FIG. 8B illustrates that the quadruplex plunger pump produces a much lower pressure ripple of 841 psi when operating at the same mean output pressure of 60,000 psi.

Figure 9:
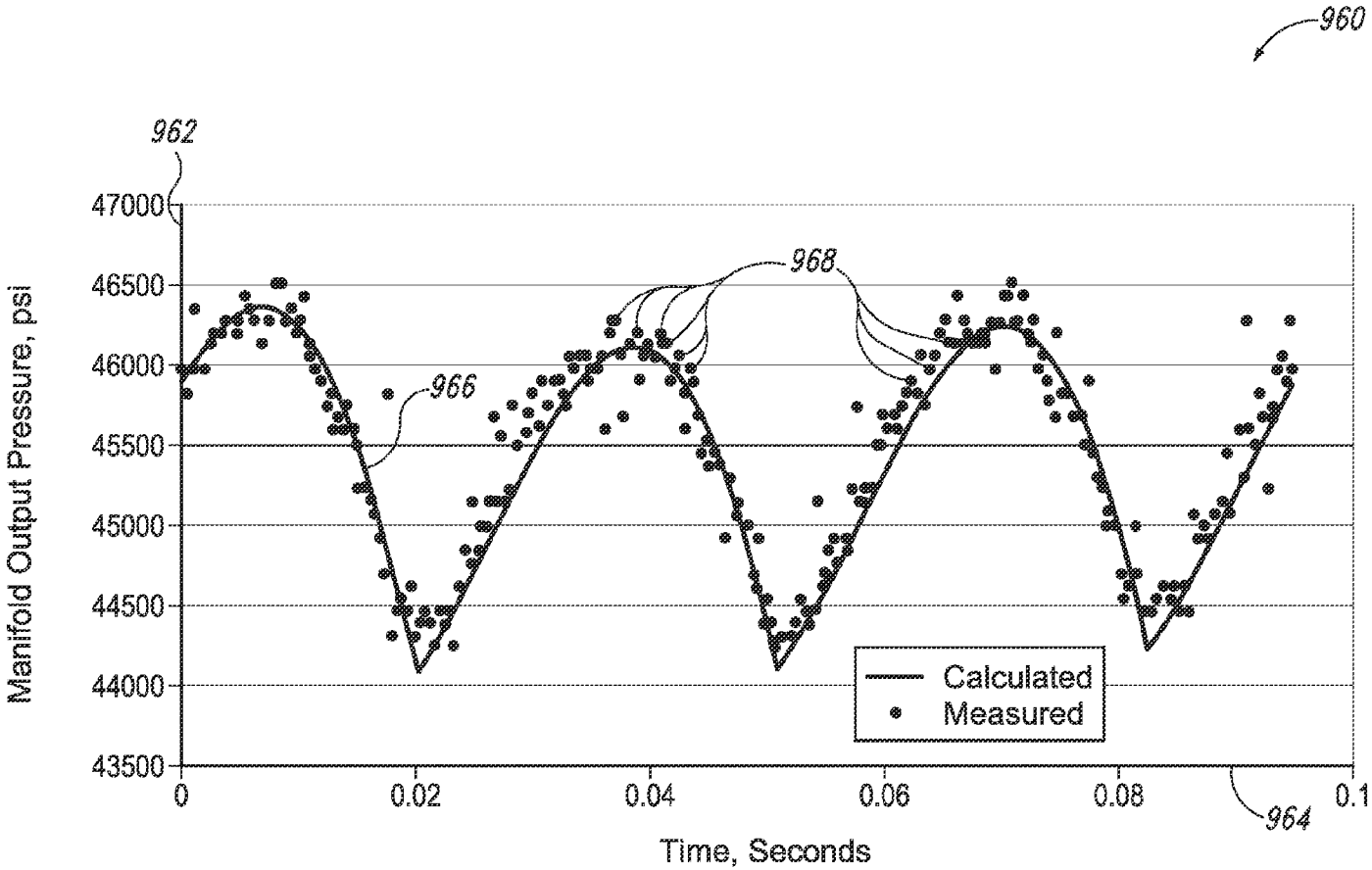
FIG. 9 is a graph comparing calculated pump manifold pressure to measured pump manifold pressure ripple for a triplex crankshaft-driven plunger pump, operating at a mean output pressure of approximately 45,500 psi, and assuming water compressibility and non-ideal check valves.

The data presented in FIGS. 1-8B was calculated using analytical tools developed specifically by the inventors, and as discussed below with reference to FIG. 9, the accuracy of these analytical tools and the unexpected results they have yielded have been verified by comparison to measured pump performance data. More specifically, FIG. 9 presents a graph 960 comparing predicted pump manifold pressure, as shown by a plot 966, to measured pump manifold pressure, as shown by the data points 968. Pump manifold pressure is measured along a vertical axis 962 in psi, and time is measured along a horizontal axis 964 in seconds. Although the horizontal axis 964 measures time, it is analogous to crankshaft angle because the crankshaft angle is a direct function of time at a given crankshaft speed. The predicted and measured manifold pressures illustrated in FIG. 9 are presented for a triplex crankshaft-driven, reciprocating plunger pump, operating at a mean output pressure of approximately 45,500 psi, and assuming water compressibility and non-ideal check valves. Although a triplex plunger pump was selected by way of example, other pump configurations could just as easily have been used to illustrate the accuracy of the predictive tool. As a comparison of the plot 966 to the data points 968 clearly illustrates, the analytical modeling tools developed by the inventors can be used to accurately predict pump pressure ripple characteristics. Prior to the development of these pump modeling tools and verification of the startling results, the inventors were fully expecting to find, as was the conventional wisdom, that triplex plunger pumps would produce less pressure ripple than quadruplex plunger pumps at pressures above 7,500 psi, such as pressures greater than 20,000 psi. As shown in FIGS. 7-8B and explained above, however, the inventors unexpectedly found that a quadruplex plunger pump actually produces increasingly less pressure ripple than a comparable triplex plunger pump as output pressure increases above about 7,500 psi.

Figure 10:
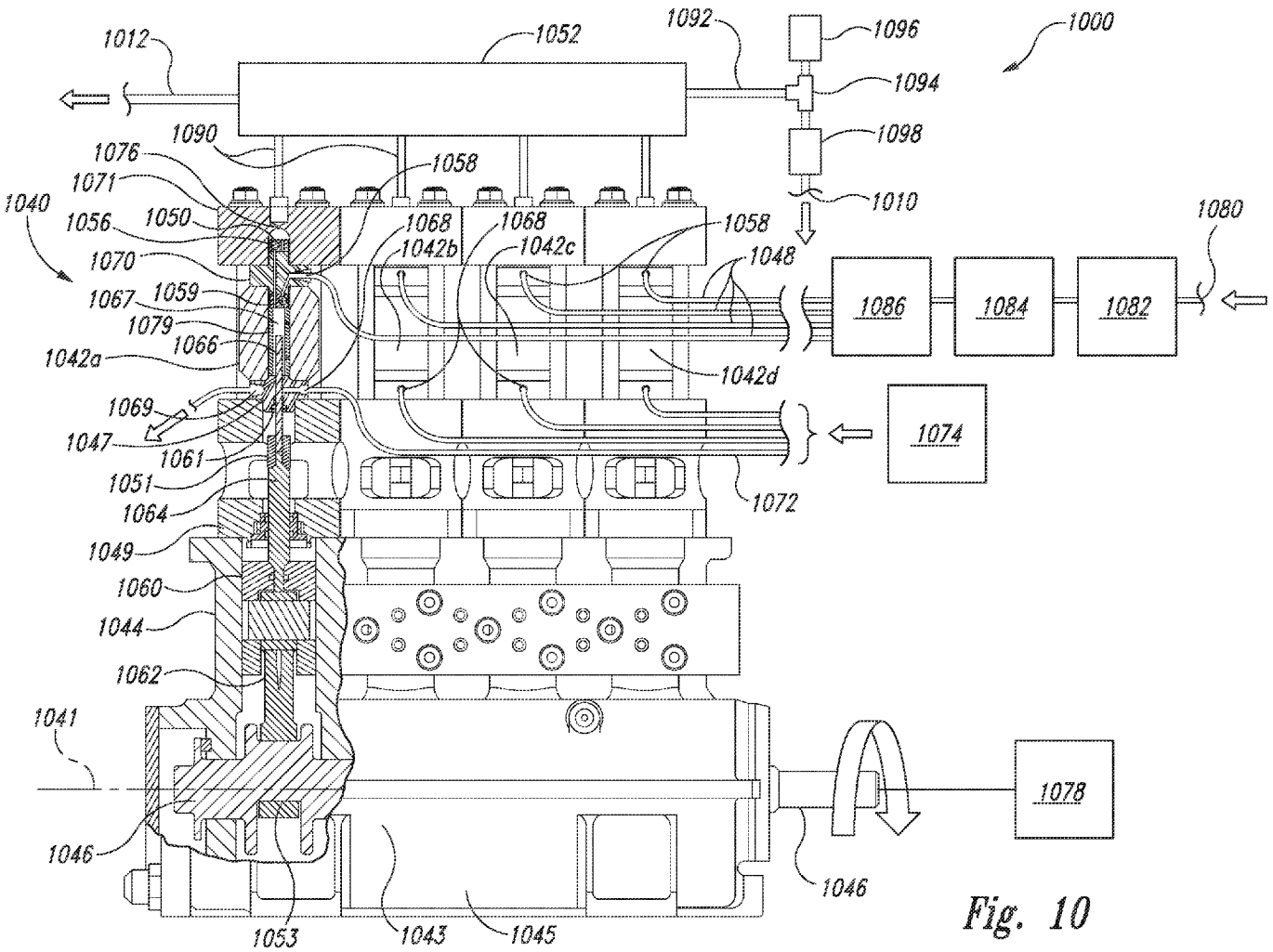
FIG. 10 is a partial cross-sectional view of a fluid pressurizing system having a quadruplex crankshaft-driven plunger pump configured in accordance with an embodiment of the present technology.

FIG. 10 is a partial cross-sectional view of a fluid pressurizing system 1000 having a quadruplex pump 1040 configured in accordance with an embodiment of the present technology. In the illustrated embodiment, the quadruplex pump 1040 is a plunger pump configured to pressurize fluid (e.g., water) to a pressure suitable for, e.g., waterjet processing. The pressure can be greater than 20,000 psi (e.g., within a range from 20,000 psi to 150,000 psi), greater than 30,000 psi (e.g., within a range from 30,000 psi to 150,000 psi), greater than 45,000 psi (e.g., within a range from 45,000 psi to 150,000 psi), greater than 60,000 psi (e.g., within a range from 60,000 psi to 150,000 psi), or greater than another suitable threshold pressure or within another suitable pressure range. In one aspect of this embodiment, the quadruplex pump 1040 includes four cylinders 1042 (identified individually as cylinders 1042*a*-1042*d*) mounted to a common crankcase 1043. More specifically, in the illustrated embodiment each cylinder 1042 is coaxially seated on an individual coolant housing 1047, which in turn is sandwiched between the base of the cylinder 1042 and an upper surface of a corresponding adapter 1049. The adapters 1049 are in turn mounted directly to an upper surface of a cylinder block 1044 in coaxial alignment with cylindrical bores in the block 1044. In this embodiment, the cylinder block 1044 forms the upper portion of the crankcase 1043, and a crankcase pan 1045 forms the lower portion.

As the cross-sectioned portion of FIG. 10 illustrates, each cylinder 1042 has associated therewith a corresponding crosshead 1060 operably coupled to a corresponding connecting rod journal 1053 on the crankshaft 1046 by a connecting rod 1062. In the illustrated embodiment, the crankshaft 1046 includes four connecting rod journals 1053 (only one is shown in FIG. 10) longitudinally spaced apart from each other along a rotational axis 1041 (i.e., the rotational centerline) of the crankshaft 1046. The connecting rod journals 1053 are eccentrically positioned relative to the rotational axis 1041 of the crankshaft 1046 to impart reciprocating motion to the corresponding crossheads 1060 during crankshaft rotation. In the illustrated embodiment, the four connecting rod journals 1053 are angularly offset from each other around the centerline of the crankshaft 1046. More specifically, the connecting rod journals 1053 are spaced apart from each other by equal angles, or at least approximately equal angles, of 90 degrees relative to the rotational axis 1041 of the crankshaft 1046. As described in greater detail below, this even spacing results in 90 degree phase angles between each plunger cycle during operational rotation of the crankshaft 1046. It should be appreciated that, in this embodiment, the four connecting rod journals 1053 can be arranged in any order along the length of the crankshaft 1046, as long as they are spaced apart from each other by 90 degree phase angles. For example, if the connecting rod journals 1053 are numbered 1-4 when viewed from left to right, they can be arranged to arrive at their TDC positions in any suitable order during crankshaft rotation, such as 1-2-3-4, 1-3-2-4, 1-4-2-3, etc.

Each crosshead 1060 receives and supports a proximal end portion of a cylindrical pony rod 1064. Each pony rod 1064 is coaxially coupled to a corresponding compression member, e.g., a cylindrical plunger 1066 via, e.g., a cylindrical sleeve adapter 1051 that couples a distal end portion of the pony rod 1064 to a proximal end portion of the plunger 1066. The plunger 1066 slidably extends through a central bore in the coolant housing 1047 and into a cylindrical compression chamber 1067 (which can also referred to as a pumping chamber) formed in the adjacent cylinder 1042. The coolant housing 1047 can include a high pressure seal 1061 for sealing the cylindrical plunger 1066 as it reciprocates back and forth in the compression chamber 1067. In contrast to a piston pump in which each piston carries one or more pressure seals that slide against the cylinder wall as the piston reciprocates, in the quadruplex plunger pump 1040 the high-pressure seal 1061 is stationary and the smooth outer surface of the cylindrical plunger 1066 slides against the seal 1061 as the plunger 1066 reciprocates. The coolant housing 1047 can include a fluid inlet 1068 for receiving liquid coolant (e.g., low pressure water) from a reservoir 1074 (shown schematically) via a conduit 1072. The coolant can circulate around the reciprocating plunger 1066 before being discharged from the coolant housing 1047 via a corresponding fluid outlet 1069.

In the illustrated embodiment, each compression chamber 1067 defines a proximal opening that is capped by the corresponding coolant housing 1047 and an opposite distal opening that is capped by a valve body 1070. The valve body 1070 is sandwiched between an upper surface of the cylinder 1042 and a corresponding retainer cap 1071. In the illustrated embodiment, a cylindrical water displacer 1079 is coaxially disposed in the cylindrical bore of the cylinder 1042 between the valve body 1070 and the coolant housing 1047. The outer cylindrical surface of the water displacer 1079 is positioned against, or at least very close, to the interior wall of the cylinder 1042, and includes having a central bore with an inner diameter that is greater than the outer diameter of the plunger 1066. As a result, there is a clearance gap or space between the outer cylindrical surface of the plunger 1066 and the inner cylindrical surface of the water displacer 1079. Each valve body 1070 includes a fluid inlet 1058 and an associated inlet check valve 1059 (e.g., a ball check valve) that permits fluid (e.g., low pressure water) from a corresponding inlet conduit 1048 to flow into the compression chamber 1067 but not out. Each valve body 1070 also includes a high pressure outlet 1050 and an associated check valve 1056 (e.g., another ball check valve) that allows water at high pressure (e.g., at a pressure greater than 20,000 psi (e.g., within a range from 20,000 psi to 150,000 psi), greater than 30,000 psi (e.g., within a range from 30,000 psi to 150,000 psi), or greater than 60,000 psi (e.g., within a range from 60,000 psi to 150,000 psi)) to flow out of the compression chamber 1067 and into a manifold 1052 via a passage 1076 in the retainer cap 1071 and an associated outlet conduit 1090. In other embodiments, the high pressure water from the compression chamber 1067 can flow into an attenuator instead of, or in addition, the manifold 1052. In the illustrated embodiment, the manifold 1052 is a pressure vessel that contains the high pressure water discharging from the cylinders 1042. The manifold 1052 can be sized to hold a sufficient amount of water to reduce pressure fluctuations resulting from the cyclic output of water from the respective cylinders 1042 and provide a relatively constant stream of water to downstream applications (e.g., waterjet processing) via a fluid conduit 1012. Although FIG. 10 illustrates the components associated with one of the cylinders 1042, the components associated with all four of the cylinders 1042 can be generally identical in structure and function in all respects pertinent to this discussion.

In the illustrated embodiment, the fluid pressurizing system 1000 can further include a charge-fluid pressuring device 1086 (e.g., a low power/pressure pump) in fluid communication with a reservoir 1084 and a conditioning unit 1082 (e.g., a filter) that receives fluid from an inlet 1080 (the pressurizing device 1086, the reservoir 1084, and the conditioning unit 1082 are shown schematically in FIG. 10). Fluid from the inlet 1080 flows through the conditioning unit 1082 and into the reservoir 1084. The charge-fluid pressurizing device 1086 can then provide the fluid to the individual compression chambers 1067 via the corresponding conduits 1048 as described above. The fluid pressurizing system 1000 can also include a drive system 1078 (e.g., a direct drive system; shown schematically) operably coupled to a distal end portion of the crankshaft 1046. The drive system 1078 can include, for example, a suitable motor (e.g., an AC electric motor of 20-50 horsepower (HP), 100 HP or other suitable capacity; an internal combustion engine; etc.) or other suitable motive device operably coupled to the crankshaft 1046 via a drive member (e.g., a belt, chain, gear set, etc.) or other suitable system known in the art. In some embodiments configured for use with waterjet systems, the drive system 1078 can include an AC electric motor and a variable frequency drive that controls the speed and/or torque of the electric motor. By way of example, the HP rating of the electric motor can be selected based on the size of waterjet cutting head orifice, the desired water pressure at the orifice, and the efficiency losses of the pump system. In some embodiments in which the electric motor is operably coupled to the crankshaft 1046 via a belt, chain or a similar drive member that extends around a first pulley on the electric motor and a second pulley on the crankshaft 1046, the pulleys can be sized to provide the desired ratio between motor speed and crankshaft speed during pump operation. If the motor is coupled to the crankshaft via a system of gears, the gears can be similarly sized to provide the desired relative speeds of the motor and the crankshaft 1046 during pump operation. In some embodiments, for example, the drive system 1078 can be configured to rotate the crankshaft 1046 at speeds in the range of 100 RPM to 2,500 RPM, or in the range of 250 RPM to 2,000 RPM, or in the range of 500 RPM to 1,500 RPM to pressurize fluid to a pressure greater than, e.g., 30,000 psi with the quadruplex plunger pump 1040. These RPM ranges can result in plunger frequencies ranging from about 6 Hz to about 170 Hz, or ranging from about 16 Hz to about 135 Hz, or ranging from about 33 Hz to about 100 Hz. In other embodiments, the fluid pressurizing system 1000 can include other types of drive systems and/or can be configured to rotate the crankshaft 1046 at other speeds and/or to provide process fluid at other pressures.

In operation, rotation of the crankshaft 1046 via the drive system 1078 causes each of the four plungers 1066 to reciprocate back and forth in the corresponding compression chamber 1067. More specifically, each plunger 1066 will reach its top dead center (TDC) and bottom dead center (BDC) positions one time during one complete rotation of the crankshaft 1046, and one of the plungers 1066 will arrive at the TDC position every 90 degrees of crankshaft rotation. As noted above, the plungers 1066 can be configured to reciprocate in any suitable order, as long as the plunger cycles are separated by equal phase angles of 90 degrees. For example, the individual plungers 1066 can be configured to arrive at their TDC positions in sequences such as: 1-2-3-4, 1-3-2-4, 1-4-2-3, etc. (with 1 being the left-most plunger an 4 being the right-most plunger). As the plungers 1066 reciprocate downwardly through their cycles, they draw low pressure water into the compression chambers 1067 via the inlet check valves 1059, and when the plungers 1066 move upwardly, they compress the water in the compression chambers 1067. When the water pressure in the compression chambers 1067 exceeds the water pressure in the manifold 1052 (e.g., a water pressure greater than about 20,000 psi), the high pressure water is discharged from the compression chamber 1067 into the manifold 1052 via the corresponding outlet check valve 1056.

In the illustrated embodiment, the fluid pressurizing system 1000 further includes a relief valve 1098 and a safety valve 1096, which are both in fluid communication with the manifold 1052 via a fluid conduit 1092 coupled to a "T" fitting 1094. More specifically, the high pressure fluid in the manifold 1052 is provided to both the safety valve 1096 and the relief valve 1098 as well as the downstream conduit 1012. In operation, the safety valve 1096 can be configured to open and release pressure in the system if the fluid exceeds a maximum safe operating pressure. The relief valve 1098 can be at least generally similar in structure and/or function to one or more of the relief valves described in U.S. patent application Ser. No. 13/969,477, titled "CONTROL VALVES FOR WATERJET SYSTEMS AND RELATED DEVICES, SYSTEMS, AND METHODS," filed on Aug. 16, 2013, now U.S. Pat. No. 8,904,912, and incorporated herein in its entirety by reference.

As described in greater detail below, in some embodiments a waterjet system configured in accordance with the present technology can include a fluid pressurizing system that is at least generally similar in structure and function to the fluid pressurizing system 1000 described above. Such waterjet systems can also include a control valve positioned relatively near to a waterjet outlet. The control valve can be configured to decrease the pressure of fluid downstream from the control valve while the pressure of fluid upstream from the control valve (e.g., fluid in the conduit 1012) remains relatively constant. The upstream fluid pressure can remain relatively constant, for example, by operation of the relief valve 1098 in concert with the control valve. More specifically, the relief valve 1098 can operate in concert with the control valve to discharge fluid from an outlet 1010 as needed to maintain the fluid in the conduit 1012 at a relatively constant pressure. In this way, most if not all portions of the high pressure fluid circuit within the waterjet system can be protected from fatigue damage associated with pressure cycling, even while the system executes intricate operations that call for modulating (e.g., rapidly modulating) the power of a jet exiting the waterjet outlet.

The quadruplex plunger pump 1040 can provide water at pressures greater than, e.g., 20,000 psi with significantly lower pressure ripple than a comparable triplex plunger pump. As illustrated by FIG. 7, for example, at a mean output pressure of 30,000 psi it is expected that a positive displacement quadruplex plunger pump configured in accordance with some embodiments of the present technology can reduce the magnitude of pressure ripples downstream of the pump (or downstream of an associated manifold) by approximately 50% or more, as compared to a comparable triplex plunger pump. Moreover, the reduction in pressure ripple increases dramatically with increased output pressure, such that the quadruplex pump can reduce the magnitude of pressure ripples by approximately 65% or more at pressures of 60,000 psi and above. Reducing pressure ripple can significantly reduce undesirable vibration and shock in downstream systems, such as waterjet systems. In some embodiments, it is expected that the reduction in pressure ripple provided by the quadruplex plunger pump 1040 will be significant enough to enable the pump 1040 to be used in waterjet systems at pressures exceeding 30,000 psi (e.g., at pressures in a range from 60,000 psi to 120,000 psi) and provide favorable results with a substantially smaller manifold than would otherwise be required with, for example, a comparable triplex plunger pump. In further embodiments, it is expected that the reduction in pressure ripple provided by the quadruplex pump 1040 will enable the pump 1040 to be used with waterjet and other systems in the absence of any downstream pressure pulsation dampeners or attenuators. In yet other embodiments, it is contemplated that the reduction in pressure ripple provided by the quadruplex pump 1040 will enable the pump 1040 to be used with waterjet and other systems in the absence of any downstream devices to reduce pressure ripple.

In some embodiments, the plungers 1066, connecting rods 1062, cylinders 1042, valve bodies 1070, inlet check valves, outlet check valves, and/or other components described above can be formed using suitable materials and methods known to those of ordinary skill in the art. For example, all or a portion of these components can be formed from suitable metals known in the art, including suitable steels, castings, aluminum alloys, etc., using suitable methods known in the art, including forging, machining, casting, etc., and/or other suitable materials and methods. Moreover, the particular embodiments of all or some of the structures and systems described above are representative of example embodiments of the present technology. Accordingly, in other embodiments, high and ultrahigh pressure positive displacement fluid pumps having four cylinders and corresponding plungers in accordance with the present technology can include other structures and systems, or some of the disclosed structures and systems may be omitted, without departing from the scope of the present technology. For example, it is contemplated that in other embodiments quadruplex plunger pumps configured in accordance with the present technology can utilize other plunger and/or cylinder arrangements. Such arrangements can include, for example, quadruplex pumps having opposing cylinders, cylinders in "V" arrangements, and other configurations while still maintaining the 90 degree plunger phase angle described above.

Figure 11A:
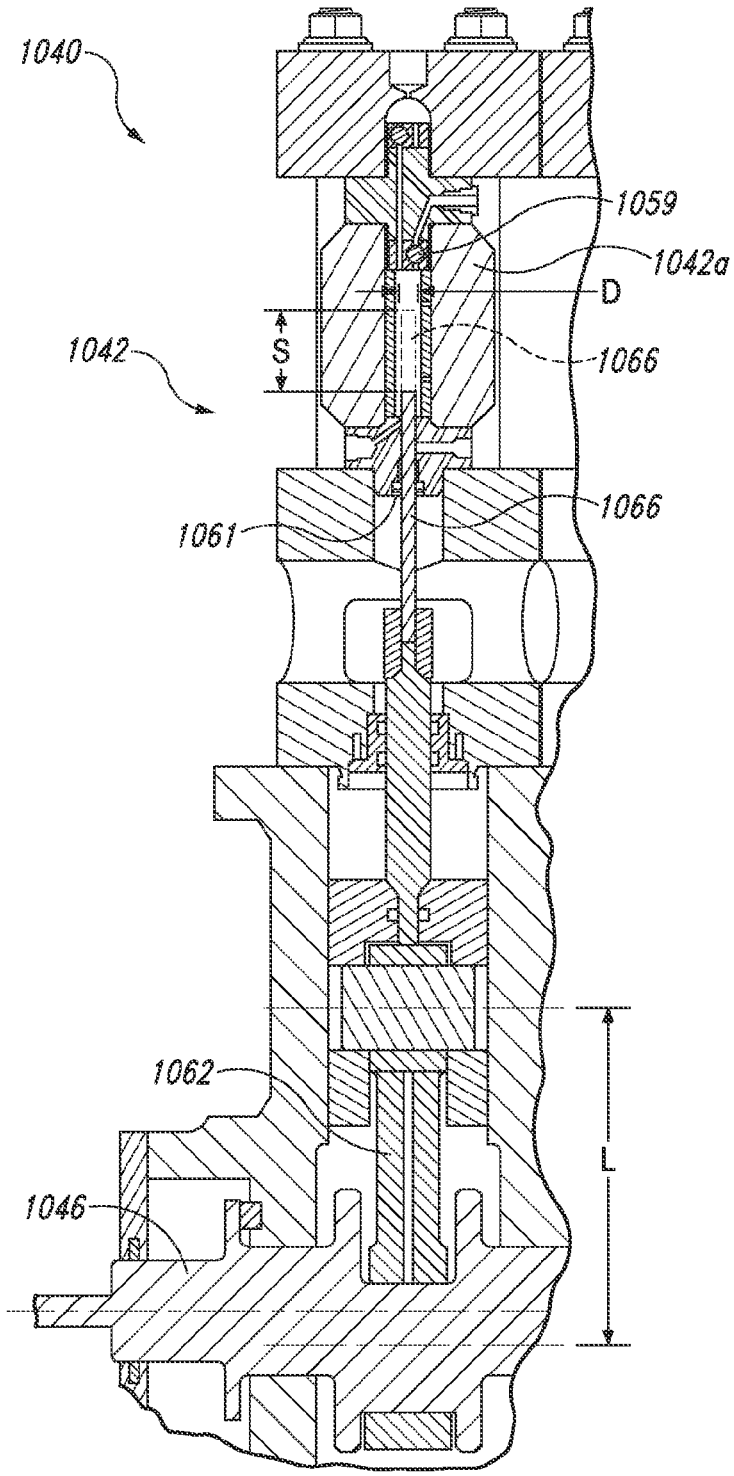
FIGS. 11A and 11B are partially schematic cross-sectional views of portions of a crankshaft-driven plunger pump and a crankshaft-driven piston pump, respectively.

FIG. 11A is an enlarged cross-sectional view of a portion of the quadruplex plunger pump 1040 described above with reference to FIG. 10. In the illustrated embodiment, the connecting rod 1062 has a length L, and rotation of the crankshaft 1046 causes the plunger 1066 to stroke through a distance S from its bottom-dead-center position (BDC) to its top-dead-center position (TDC). By way of example, in some embodiments the connecting rod length L can be from about 1 inch to about 24 inches or more, or from about 3 inches to about 11 inches, or 4.25 inches; and the stroke S can be from about 0.25 inch to about 10 inches or more, or from about 0.35 inch to about 3 inches, or 1.75 inches. The plunger 1066 has a diameter D which results in a cross-sectional area A. In some embodiments, the plunger diameter D can be from about 0.1 inch to about 2 inches or more, or from about 0.20 inch to about 0.50 inch, or 0.3125 inch, resulting in a plunger area A of from about 0.008 $in^2$ to about 3.14 $in^2$, or 0.077 $in^2$. The plunger area A can be multiplied by the plunger stroke S to produce a plunger swept volume Vs. The open volume remaining in the cylinder 1041 when the plunger is at the TDC position can be referred to as the cylinder dead volume Vd. In some embodiments, Vd can be from about 0.01 $in^3$ to about 20 $in^3$ or more, or from about 0.05 $in^3$ to about 1.0 $in^3$, or about 0.19 $in^3$. The internal volume in the manifold 1052 can be defined as Vo. By way of example, in some embodiments Vo can be from about 1.0 $in^3$ or less to about 600 $in^3$ or more, or from about 2 $in^3$ to about 80 $in^3$, or about 8.2 $in^3$. As the plunger 1066 moves upward on the compression stroke, a small portion of process fluid (e.g. water) leaks out of the cylinder 1042 past the inlet check valve 1059. The volume of leakage can be equated to a portion of plunger travel Xi, such that (Xi)×(A) equals the volume of leakage out of the cylinder 1042 past the inlet check valve. Similarly, when the plunger 1066 moves downward on the intake stroke, a small portion of the process fluid leaks into the cylinder 1042 past the outlet check valve 1056. This volume of leakage can be equated to another portion of plunger travel Xo, such that (Xo)×(A) equals the volume of leakage past the outlet check valve. By way of example, in some embodiments both Xi and Xo can be from about 0 inch (e.g., ideal check valve) to about 0.2 inch or more, or from about 0.01 inch to about 0.050 inch, or about 0.012 inch. The total number of cylinders 1042 of the pump 1040 (i.e., four) can be represented by the letter n.

The pump variables described above can be expressed in ratios, such as: L/S, Vd/Vs, Vo/(nVs), Xi/S and Xo/S. When these ratios have the same values for two pumps having the same number of cylinders n, each pump will have the same ripple form and magnitude. These ratios can also affect the volumetric efficiency of positive displacement reciprocating pumps. The term volumetric efficiency can be defined as the ratio of the volume of fluid actually displaced from a pump cylinder by a plunger or piston to its swept volume. By way of example, the inventors have found that, in some embodiments, quadruplex pumps provide favorable ripple and other performance characteristics when these ratios are selected from within the ranges shown below:

(1) $2.3 \leq L/S \leq 6.5$
(2) $0.5 \leq Vd/Vs \leq 4.0$; or $0.5 \leq Vd/Vs \leq 2.0$
(3) $10 \leq Vo/(nVs) \leq 150$
(4) $0 \leq Xi/S \leq 0.02$
(5) $0 \leq Xo/S \leq 0.02$ More specifically, in some embodiments the quadruplex plunger pump 1040 can provide water at pressures suitable for, e.g., waterjet processing and with relatively low pressure ripple, as compared to a triplex plunger pump, when the ratios presented above are selected from within the ranges shown. The pressure can be greater than 20,000 psi (e.g., within a range from 20,000 psi to 150,000 psi), greater than 30,000 psi (e.g., within a range from 30,000 psi to 150,000 psi), greater than 60,000 psi (e.g., within a range from 60,000 psi to 150,000 psi), or greater than another suitable threshold pressure or within another suitable pressure range. It should be noted that these variable values and ratios described above are representative of certain embodiments and are not limiting. Accordingly, in other embodiments, other values can be selected for the pump variables described above to provide high pressure water with relatively low pressure ripple from a quadruplex plunger pump configured in accordance with the present technology.

Figure 11B:
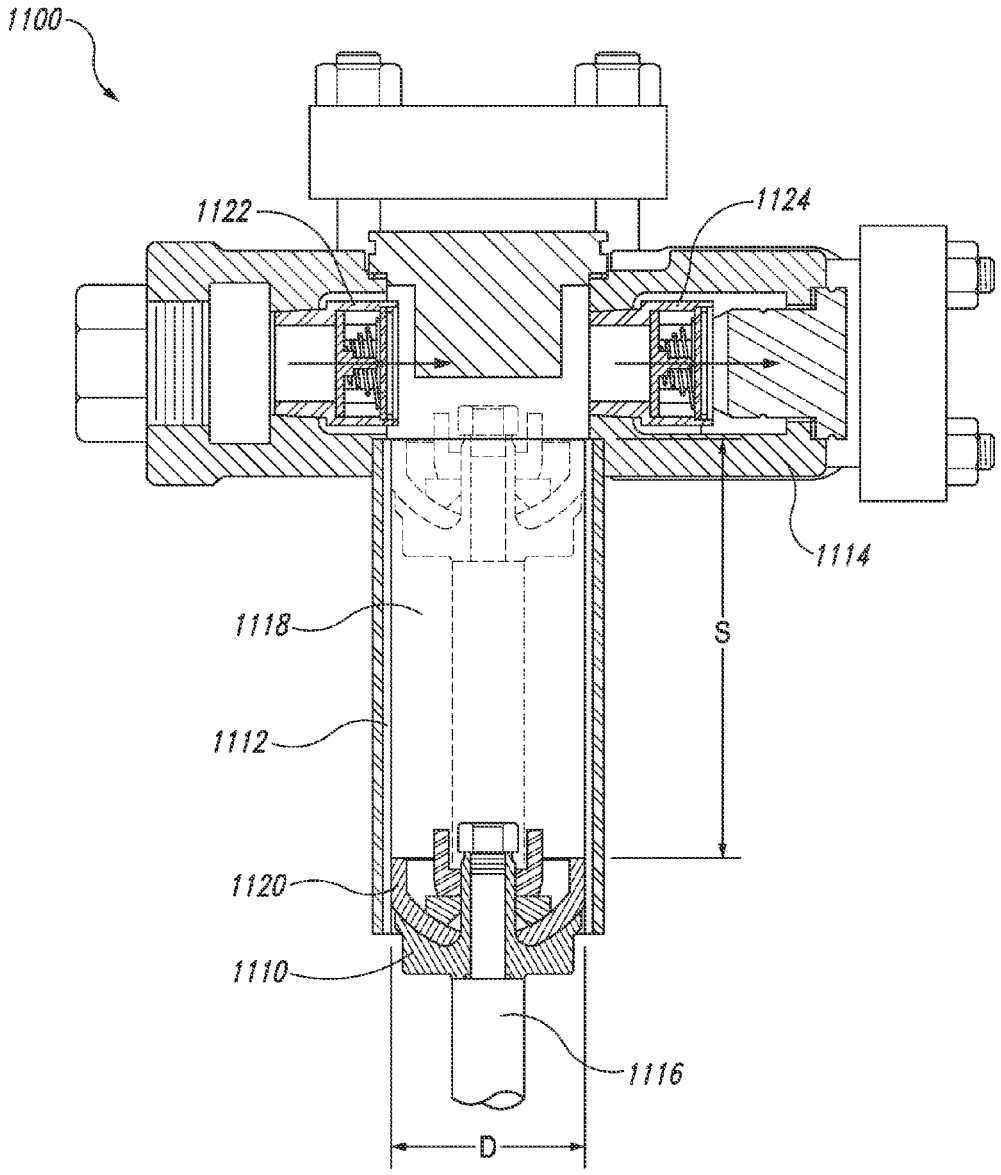

FIG. 11B is a schematic cross-sectional view of a portion of a triplex positive displacement, reciprocating piston pump 1100. The piston pump 1100 includes a piston 1110 that reciprocates back and forth through a stroke S in a compression chamber 1118 defined by a cylinder liner 1112. The piston 1110 has a diameter D, and carries one or more annular seals 1120 configured to prevent pressure losses between the piston 1110 and the liner wall during pump operation. By way of example, such piston pumps can have a stroke S of about 14 inches, and piston diameters D of from about 5 inches to about 6.5 inches. The piston 1110 is mounted to a distal end portion of a piston rod 1116. Although not shown, the piston rod 1116 can be operably coupled to a cross-head, which is in turn coupled to a crankshaft via a connecting rod. A valve body 1114 can be fixedly attached to the upper portion of the liner 1112 to seal the pump chamber. The valve body 1114 can contain an inlet check valve 1122 (i.e., a one-way valve) for permitting process fluid comprising, e.g., water to flow into the compression chamber 1118 as the piston 1110 moves downwardly on the intake stroke, and an outlet check valve 1124 that permits the pressurized water to flow out of the compression chamber 1118 as the piston 1110 moves upwardly on the compression stroke.

Reciprocating piston pumps, like the triplex piston pump 1100, are typically not used in high pressure applications (e.g., pressures above 15,000 psi). For example, such piston pumps typically have maximum operational output pressures of from about 5,500 psi to about 7,500 psi. One reason that piston pumps are not typically used in high pressure applications is that the connecting rod loads on the crankshaft become increasingly high at high output pressures because of the relatively large surface area of the piston 1110 and the relatively long piston stroke S (in contrast to, for example, the relatively small diameter of the plunger 1066 of the quadruplex pump 1040 of FIG. 11A). At pressures approaching 10,000 psi, these high connecting rod loads require expensive, heavy-duty power end components to avoid rapid wear and premature failure of the power end of the pump 1100. Another reason for the relatively low pressures of piston pumps is that the piston seal 1120 is prone to premature failure or loss of performance (leading to frequent service and/or replacement) at high pressures. In operation, the piston seal 1120 slides against the cylinder liner 1112 as the piston 1110 compresses the process fluid in the pressure chamber 1118. The friction force on the seal 1120 combined with the internal pressure exerts high stress on the seal 1120, causing it to wear rapidly, degrading pump performance and requiring frequent service. Yet another reason that piston pumps are typically not used in high pressure applications is that the high pressures can cause small particles in the process fluid (dirt and other solids) to scratch and damage the piston liner 1112. These scratches accumulate over time, and can reduce pump performance if the liner 1112 is not replaced periodically.

In general, piston pumps (such as the piston pump 1100 of FIG. 11B) can have higher volumetric efficiencies than comparable plunger pumps, because piston pumps potentially have a smaller ratio of cylinder dead volume Vd to piston swept volume Vs than comparable plunger pumps. The inventors have found that there is a relationship between the volumetric efficiency of a positive displacement, reciprocating piston or plunger pump and the output pressure at which a quadruplex version of the pump will produce less pressure ripple than a triplex version of the pump. Specifically, the higher the volumetric efficiency, the higher the output pressure at which a quadruplex pump produces less pressure ripple than a comparable triplex pump. This is why triplex piston pumps, with relatively high volumetric efficiencies, would not see a reduction in pressure ripple at their operating pressures by adding a cylinder to create a quadruplex piston pump. Accordingly, the reduction in pressure ripple provided by a quadruplex plunger pump over a triplex plunger pump is more predominant for plunger pumps having relatively low volumetric efficiencies and operating at relatively high pressures, such as pressures greater than about 20,000 psi. Since reciprocating piston pumps tend to operate at pressures much lower than 15,000 psi, and since such pumps tend to have higher volumetric efficiencies than plunger pumps, increasing the number of cylinders of such piston pumps from three to four does not provide a beneficial reduction in pressure ripple, as is illustrated by FIG. 3 above.

Figure 12:
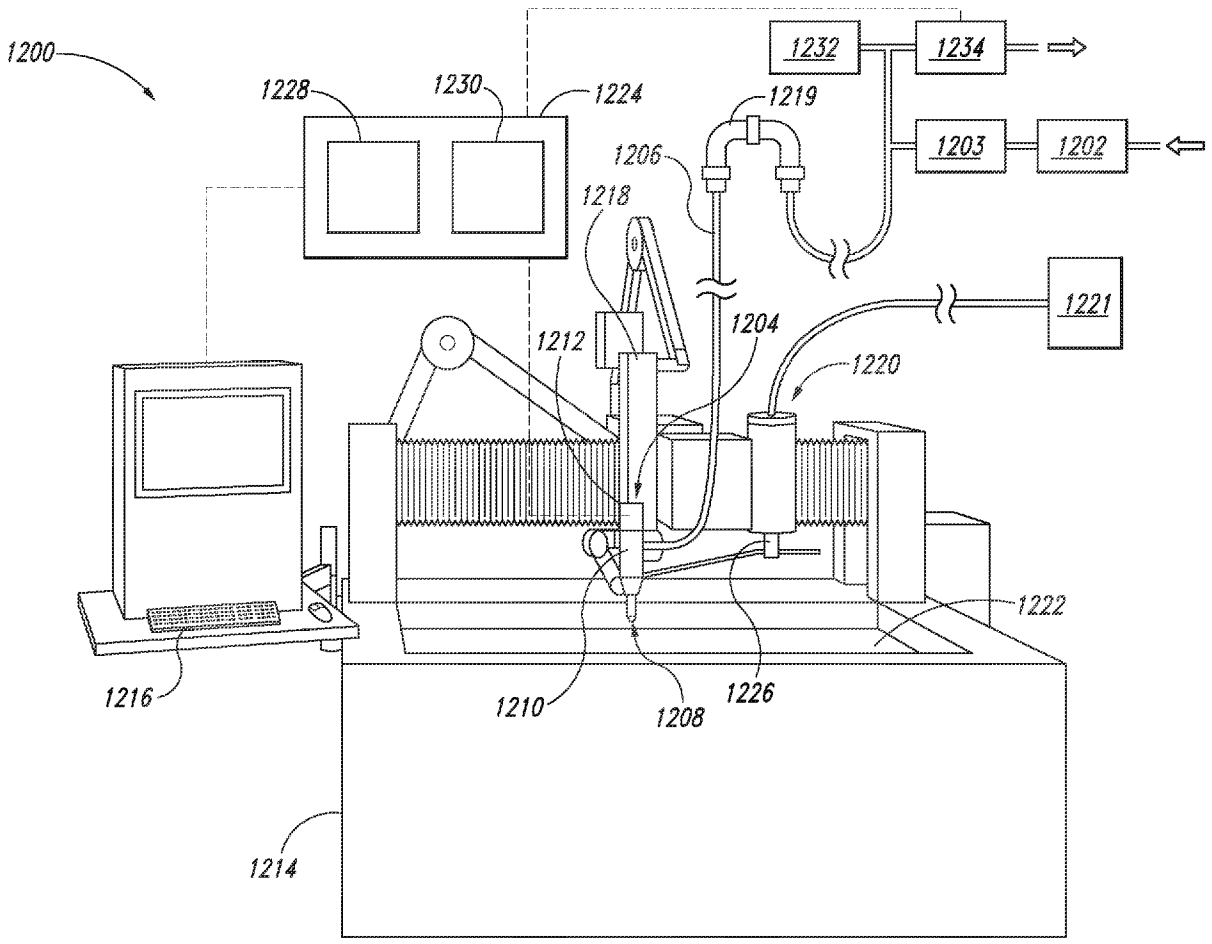
FIG. 12 is a partially schematic perspective view of a waterjet system including a quadruplex plunger pump configured in accordance with an embodiment of the present technology.

FIG. 12 is a perspective view of a waterjet system 1200 configured in accordance with an embodiment of the present technology. The waterjet system 1200 includes a fluid-pressurizing device 1202 (shown schematically) configured to pressurize a fluid (e.g., water) to a pressure suitable for waterjet processing. In some embodiments, the fluid-pressurizing device 1202 can be a quadruplex pump, such as a quadruplex plunger pump that is at least generally similar in structure and/or function to the quadruplex plunger pump 1040 described in detail above with reference to FIG. 10. The fluid-pressurizing device 1202 can be configured to discharge the high pressure fluid into a manifold 1203. In some embodiments, the manifold 1203 can be at least generally similar in structure and/or function to the manifold 1052 described above with reference to FIG. 10. The waterjet system 1200 can further include a waterjet assembly 1204 operably connected to the fluid-pressurizing device 1202 via a conduit 1206 extending between the manifold 1203 and the waterjet assembly 1204. In the illustrated embodiment, the conduit 1206 is also connected in fluid communication to a safety valve 1232 and a relief valve 1234. The safety valve 1232 and the relief valve 1234 can be at least generally similar in structure and/or function to the safety valve 1096 and the relief valve 1098, respectively, described above with reference to FIG. 10.

The waterjet assembly 1204 can include a jet outlet 1208 and a control valve 1210 upstream from the jet outlet 1208. The control valve 1210 can be at least generally similar in structure and/or function to one or more of the control valves described in U.S. patent application Ser. No. 13/969,477, titled "CONTROL VALVES FOR WATERJET SYSTEMS AND RELATED DEVICES, SYSTEMS, AND METHODS," filed on Aug. 16, 2013, now U.S. Pat. No. 8,904,912, and incorporated herein in its entirety by reference. For example, the control valve 1210 can be configured to receive fluid from the fluid-pressurizing device 1202 via the conduit 1206 at a pressure suitable for waterjet processing (e.g., a pressure greater than 30,000 psi) and to selectively reduce the pressure of the fluid as the fluid flows through the control valve 1210 toward the jet outlet 1208. For example, in some embodiments the waterjet assembly 1204 can include a first actuator 1212 configured to control the position of a pin (not shown) within the control valve 1210 and thereby selectively reduce the pressure of the fluid.

The waterjet system 1200 can further include a user interface 1216 supported by a base 1214, and a second actuator 1218 configured to move the waterjet assembly 1204 relative to the base 1214 and other stationary components of the system 1200 (e.g., the fluid-pressurizing device 1202). For example, the second actuator 1218 can be configured to move the waterjet assembly 1204 along a processing path (e.g., cutting path) in two or three dimensions and, in at least some cases, to tilt the waterjet assembly 1204 relative to the base 1214. The conduit 1206 can include a joint 1219 (e.g., a swivel joint or another suitable joint having two or more degrees of freedom) configured to facilitate movement of the waterjet assembly 1204 relative to the base 1214. Thus, the waterjet assembly 1204 can be configured to direct a jet including the fluid toward a workpiece (not shown) supported by the base 1214 (e.g., held in a jig supported by the base 1214) and to move relative to the base 1214 while directing the jet toward the workpiece.

The system 1200 can further include an abrasive-delivery apparatus 1220 configured to feed particulate abrasive material from an abrasive material source 1221 to the waterjet assembly 1204 (e.g., partially or entirely in response to a Venturi effect associated with a fluid jet passing through the waterjet assembly 1204). Within the waterjet assembly 1204, the particulate abrasive material can accelerate with the jet before being directed toward the workpiece through the jet outlet 1208. In some embodiments the abrasive-delivery apparatus 1220 is configured to move with the waterjet assembly 1204 relative to the base 1214. In other embodiments, the abrasive-delivery apparatus 1220 can be configured to be stationary while the waterjet assembly 1204 moves relative to the base 1214. The base 1214 can include a diffusing tray 1222 configured to hold a pool of fluid positioned relative to the jig so as to diffuse kinetic energy of the jet from the waterjet assembly 1204 after the jet passes through the workpiece.

The system 1200 can also include a controller 1224 (shown schematically) operably connected to the user interface 1216, the first actuator 1212, the second actuator 1218, and the relief valve 1234. In some embodiments, the controller 1224 is also operably connected to an abrasive-metering valve 1226 (shown schematically) of the abrasive-delivery apparatus 1220. In other embodiments, the abrasive-delivery apparatus 1220 can be without the abrasive-metering valve 1226 or the abrasive-metering valve 1226 can be configured for use without being operably associated with the controller 1224. The controller 1224 can include a processor 1228 and memory 1230 and can be programmed with instructions (e.g., non-transitory instructions contained on a computer-readable medium) that, when executed, control operation of the system 1200. For example, the controller 1224 can control operation of the control valve 1210 (via the first actuator 1212) in concert with operation of the relief valve 1234 to decrease the pressure of fluid downstream from the control valve 1210 while the pressure of fluid upstream from the control valve remains relatively constant.

CONCLUSION

This disclosure is not intended to be exhaustive or to limit the present technology to the precise forms disclosed herein. Although specific embodiments are disclosed herein for illustrative purposes, various equivalent modifications are possible without deviating from the present technology, as those of ordinary skill in the relevant art will recognize. Accordingly, this disclosure and associated technology can encompass other embodiments not expressly shown or described herein. In some cases, well-known structures and functions have not been shown or described in detail to avoid unnecessarily obscuring the description of embodiments of the present technology. Although steps of methods may be presented herein in a particular order, in alternative embodiments, the steps may have another suitable order. Similarly, certain aspects of the present technology disclosed in the context of particular embodiments can be combined or eliminated in other embodiments. Furthermore, while advantages associated with certain embodiments may have been disclosed in the context of those embodiments, other embodiments can also exhibit such advantages, and not all embodiments need necessarily exhibit such advantages or other advantages disclosed herein to fall within the scope of the present technology.

It should be noted that other embodiments in addition to those disclosed herein are within the scope of the present technology. For example, embodiments of the present technology can have different configurations, components, and/or procedures than those shown or described herein. Moreover, a person of ordinary skill in the art will understand that embodiments of the present technology can have configurations, components, and/or procedures in addition to those shown or described herein and that these and other embodiments can be without several of the configurations, components, and/or procedures shown or described herein without deviating from the present technology.

Certain aspects of the present technology may take the form of computer-executable instructions, including routines executed by a controller or other data processor. In some embodiments, a controller or other data processor is specifically programmed, configured, or constructed to perform one or more of these computer-executable instructions. Furthermore, some aspects of the present technology may take the form of data (e.g., non-transitory data) stored or distributed on computer-readable media, including magnetic or optically readable or removable computer discs as well as media distributed electronically over networks. Accordingly, data structures and transmissions of data particular to aspects of the present technology are encompassed within the scope of the present technology. The present technology also encompasses methods of both programming computer-readable media to perform particular steps and executing the steps. The methods disclosed herein include and encompass, in addition to methods of making and using the disclosed apparatuses and systems, methods of instructing others to make and use the disclosed apparatuses and systems.

Throughout this disclosure, the singular terms "a," "an," and "the" include plural referents unless the context clearly indicates otherwise. Similarly, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Additionally, the terms "comprising" and the like are used throughout this disclosure to mean including at least the recited feature(s) such that any greater number of the same feature(s) and/or one or more additional types of features are not precluded. Directional terms, such as "upper," "lower," "front," "back," "vertical," and "horizontal," may be used herein to express and clarify the relationship between various elements. It should be understood that such terms do not denote absolute orientation. Reference herein to "one embodiment," "an embodiment," or similar formulations means that a particular feature, structure, operation, or characteristic described in connection with the embodiment can be included in at least one embodiment of the present technology. Thus, the appearances of such phrases or formulations herein are not necessarily all referring to the same embodiment. Furthermore, various particular features, structures, operations, or characteristics may be combined in any suitable manner in one or more embodiments.

References throughout the foregoing description to features, advantages, or similar language do not imply that all of the features and advantages that may be realized with the present technology should be or are in any single embodiment of the invention. Rather, language referring to the features and advantages is understood to mean that a specific feature, advantage, or characteristic described in connection with an embodiment is included in at least one embodiment of the present technology. Thus, discussion of the features and advantages, and similar language, throughout this specification may, but do not necessarily, refer to the same embodiment.

From the foregoing, it will be appreciated that specific embodiments of the invention have been described herein for purposes of illustration, but that various modifications may be made without deviating from the spirit and scope of the various embodiments of the invention. Accordingly, the invention is not limited, except as by the appended claims. Although certain aspects of the invention may be presented below in certain claim forms, the applicant contemplates the various aspects of the invention in any number of claim forms. Accordingly, the applicant reserves the right to pursue additional claims after filing this application to pursue such additional claim forms.

We claim:

1. A fluid pressurizing system configured to provide fluid at a pressure greater than 20,000 psi, the fluid pressurizing system comprising:

a crankcase;

a crankshaft rotatably disposed in the crankcase;

four cylinders coupled to the crankcase;

a fluid inlet and a fluid outlet associated with each cylinder;

four reciprocating members, wherein each of the reciprocating members is operably disposed in a corresponding one of the cylinders and operably coupled to the crankshaft, and wherein rotation of the crankshaft moves each of the reciprocating members through a cycle configured to draw fluid into the corresponding cylinder through the fluid inlet and drive fluid out of the corresponding cylinder through the fluid outlet at a pressure greater than 20,000 psi; and four connecting rods of length L, wherein the crankshaft includes four offset journals, and wherein each of the reciprocating members is operably coupled to a corresponding one of the journals via a corresponding one of the connecting rods, wherein rotation of the crankshaft moves each of the reciprocating members through a stroke distance S, and wherein $2.3 \leq L/S \leq 6.5$.

2. The fluid pressurizing system of claim 1 wherein there are not more than four reciprocating members operably coupled to the crankshaft and not more than four corresponding cylinders mounted to the crankcase.

3. The fluid pressurizing system of claim 1 wherein each of the four reciprocating members is a plunger having an exterior cylindrical surface that is spaced apart from an interior surface of the corresponding cylinder to provide a volume therebetween configured to be at least partially filled by the fluid during operation of the fluid pressurizing system.

4. The fluid pressurizing system of claim 1 wherein each of the four reciprocating members is a plunger having an exterior cylindrical surface that slides against a high pressure seal to seal the corresponding cylinder during operation of the fluid pressurizing system.

5. The fluid pressurizing system of claim 1 wherein the four reciprocating members operate 90 degrees out of phase with each other during rotation of the crankshaft.

6. The fluid pressurizing system of claim 1 wherein the journals are spaced apart from each other by 90 degree angles relative to a rotational centerline of the crankshaft.

7. The fluid pressurizing system of claim 1 wherein the fluid pressurizing system is configured to pressurize fluid to a pressure greater than 30,000 psi.

8. The fluid pressurizing system of claim 1 wherein the fluid pressurizing system is configured to pressurize fluid to a pressure greater than 30,000 psi and less than 150,000 psi.

9. The fluid pressurizing system of claim 1 wherein the fluid pressurizing system is configured to pressurize fluid to a pressure greater than 60,000 psi and less than 150,000 psi.

10. The fluid pressurizing system of claim 1 wherein movement of the individual reciprocating members in a first direction draws a process fluid comprising water into the corresponding cylinders through the associated fluid inlets, and wherein movement of the individual reciprocating members in a second direction opposite to the first direction pressurizes the process fluid in the cylinders and drives the process fluid out of the cylinders through the associated fluid outlets to a downstream application in the absence of a pressure pulsation dampener in fluid communication with the fluid outlets.

11. The fluid pressurizing system of claim 1, further comprising a manifold in fluid communication with the fluid outlets, wherein movement of the individual reciprocating members in a first direction draws a process fluid comprising water into the corresponding cylinders through the associated fluid inlets, wherein movement of the individual reciprocating members in a second direction opposite to the first direction pressurizes the process fluid in the cylinders and drives the process fluid out of the cylinders and into the manifold through the associated fluid outlets, and wherein the fluid flows from the manifold to a downstream application in the absence of a pressure pulsation dampener or pressure attenuator for reducing pressure ripple downstream of the manifold.

12. The fluid pressurizing system of claim 1 wherein each of the cylinders has associated therewith a dead volume Vd and a reciprocating member swept volume Vs, and wherein $0.5 \leq Vd/Vs \leq 4.0$.

13. The fluid pressurizing system of claim 1, further comprising a manifold having an internal volume Vo, wherein rotation of the crankshaft drives the fluid out of the cylinders and into the internal volume of the manifold through the fluid outlets at a pressure greater than 20,000 psi, wherein each of the cylinders has associated therewith a reciprocating member swept volume Vs, and wherein $10 \leq Vo/(4Vs) \leq 150$.

14. The fluid pressurizing system of claim 13 wherein each of the cylinders has associated therewith a dead volume Vd, and wherein $0.5 \leq Vd/Vs \leq 4.0$.

15. A fluid pressurizing system configured to provide fluid at a pressure greater than 20,000 psi, fluid pressurizing system comprising:

a crankcase;

a crankshaft rotatably disposed in the crankcase;

four cylinders coupled to the crankcase;

a fluid inlet and a fluid outlet associated with each cylinder;

four reciprocating members, wherein each of the reciprocating members is operably disposed in a corresponding one of the cylinders and operably coupled to the crankshaft, and wherein rotation of the crankshaft moves each of the reciprocating members through a cycle configured to draw fluid into the corresponding cylinder through the fluid inlet and drive fluid out of the corresponding cylinder through the fluid outlet at a pressure greater than 20,000 psi, and wherein each of the cylinders has associated therewith a dead volume Vd and a reciprocating member swept volume Vs, and wherein $0.5 \leq Vd/Vs \leq 4.0$.

16. The fluid pressurizing system of claim 15 wherein $0.5 \leq Vd/Vs \leq 2.0$.

17. The fluid pressurizing system of claim 15 wherein there are not more than four reciprocating members operably coupled to the crankshaft and not more than four corresponding cylinders mounted to the crankcase.

18. The fluid pressurizing system of claim 15 wherein each of the four reciprocating members is a plunger having an exterior cylindrical surface that is spaced apart from an interior surface of the corresponding cylinder to provide a volume therebetween configured to be at least partially filled by the fluid during operation of the fluid pressurizing system.

19. The fluid pressurizing system of claim 15 wherein each of the four reciprocating members is a plunger having an exterior cylindrical surface that slides against a high pressure seal to seal the corresponding cylinder during operation of the fluid pressurizing system.

20. The fluid pressurizing system of claim 15 wherein the four reciprocating members operate 90 degrees out of phase with each other during rotation of the crankshaft.

21. The fluid pressurizing system of claim 15 wherein the crankshaft includes four offset journals, wherein each of the reciprocating members is operably coupled to a corresponding one of the journals, and wherein the journals are spaced apart from each other by 90 degree angles relative to a rotational centerline of the crankshaft.

22. The fluid pressurizing system of claim 15, further comprising a manifold having an internal volume Vo, wherein rotation of the crankshaft drives the fluid out of the cylinders and into the internal volume of the manifold through the fluid outlets at a pressure greater than 20,000 psi, wherein each of the cylinders has associated therewith a reciprocating member swept volume Vs, and wherein $10 \leq Vo/(4Vs) \leq \leq 150$.

23. The fluid pressurizing system of claim 15 wherein the fluid pressurizing system is configured to pressurize fluid to a pressure greater than 60,000 psi and less than 150,000 psi.

24. The fluid pressurizing system of claim 15 wherein movement of the individual reciprocating members in a first direction draws a process fluid comprising water into the corresponding cylinders through the associated fluid inlets, and wherein movement of the individual reciprocating members in a second direction opposite to the first direction pressurizes the process fluid in the cylinders and drives the process fluid out of the cylinders through the associated fluid outlets to a downstream application in the absence of a pressure pulsation dampener in fluid communication with the fluid outlets.

25. The fluid pressurizing system of claim 15, further comprising a manifold in fluid communication with the fluid outlets, wherein movement of the individual reciprocating members in a first direction draws a process fluid comprising water into the corresponding cylinders through the associated fluid inlets, wherein movement of the individual reciprocating members in a second direction opposite to the first direction pressurizes the process fluid in the cylinders and drives the process fluid out of the cylinders and into the manifold through the associated fluid outlets, and wherein the fluid flows from the manifold to a downstream application in the absence of a pressure pulsation dampener or pressure attenuator for reducing pressure ripple downstream of the manifold.

26. A fluid pressurizing system configured to provide a fluid at a pressure greater than 20,000 psi, the fluid pressurizing system comprising:

a crankcase;

a crankshaft rotatably disposed in the crankcase;

four cylinders coupled to the crankcase;

a fluid inlet and a fluid outlet associated with each cylinder;

four reciprocating members, wherein each of the reciprocating members is operably disposed in a corresponding one of the cylinders and operably coupled to the crankshaft, and wherein rotation of the crankshaft moves each of the reciprocating members through a cycle configured to draw fluid into the corresponding cylinder through the fluid inlet and drive fluid out of the corresponding cylinder through the fluid outlet at a pressure greater than 20,000 psi; and a manifold having an internal volume Vo, wherein rotation of the crankshaft drives the fluid out of the cylinders and into the internal volume of the manifold through the fluid outlets at a pressure greater than 20,000 psi, wherein each of the cylinders has associated therewith a reciprocating member swept volume Vs, and wherein $10 \leq Vo/(4Vs) \leq 150$.

27. The fluid pressurizing system of claim 26 wherein there are not more than four reciprocating members operably coupled to the crankshaft and not more than four corresponding cylinders mounted to the crankcase.

28. The fluid pressurizing system of claim 26 wherein each of the four reciprocating members is a plunger having an exterior cylindrical surface that is spaced apart from an interior surface of the corresponding cylinder to provide a volume therebetween configured to be at least partially filled by the fluid during operation of the fluid pressurizing system.

29. The fluid pressurizing system of claim 26 wherein each of the four reciprocating members is a plunger having an exterior cylindrical surface that slides against a high pressure seal to seal the corresponding cylinder during operation of the fluid pressurizing system.

30. The fluid pressurizing system of claim 26 wherein the four reciprocating members operate 90 degrees out of phase with each other during rotation of the crankshaft.

31. The fluid pressurizing system of claim 26 wherein the crankshaft includes four offset journals, wherein each of the reciprocating members is operably coupled to a corresponding one of the journals, and wherein the journals are spaced apart from each other by 90 degree angles relative to a rotational centerline of the crankshaft.

32. The fluid pressurizing system of claim 26 wherein the fluid pressurizing system is configured to pressurize fluid to a pressure greater than 60,000 psi and less than 150,000 psi.

33. The fluid pressurizing system of claim 26 wherein movement of the individual reciprocating members in a first direction draws a process fluid comprising water into the corresponding cylinders through the associated fluid inlets, wherein movement of the individual reciprocating members in a second direction opposite to the first direction pressurizes the process fluid in the cylinders and drives the process fluid out of the cylinders and into the manifold through the associated fluid outlets, and wherein the fluid flows from the manifold to a downstream application in the absence of a pressure pulsation dampener or pressure attenuator for reducing pressure ripple downstream of the manifold.

* * * * *